US010269308B2

(12) United States Patent
Yang et al.

(10) Patent No.: US 10,269,308 B2
(45) Date of Patent: Apr. 23, 2019

(54) APPARATUS AND METHOD FOR CONTROLLING LIQUID CRYSTAL DISPLAY BRIGHTNESS, AND LIQUID CRYSTAL DISPLAY DEVICE

(71) Applicant: HISENSE ELECTRIC CO., LTD., Qingdao (CN)

(72) Inventors: Jia Yang, Qingdao (CN); Yuxin Zhang, Qingdao (CN); Shunming Huang, Qingdao (CN); Yujie Diao, Qingdao (CN)

(73) Assignees: Hisense Electric Co., Ltd., Qingdao (CN); Hisense USA Corporation, Suwanee, GA (US); Hisense International Co., Ltd., Qingdao (CN)

( * ) Notice: Subject to any disclaimer, the term of this patent is extended or adjusted under 35 U.S.C. 154(b) by 134 days.

(21) Appl. No.: 15/158,759

(22) Filed: May 19, 2016

(65) Prior Publication Data

US 2017/0084232 A1 Mar. 23, 2017

(30) Foreign Application Priority Data

Sep. 17, 2015 (CN) ..... 2015 1 0592299

(51) Int. Cl.
*G09G 3/34* (2006.01)
*G09G 3/36* (2006.01)

(52) U.S. Cl.
CPC ..... *G09G 3/3426* (2013.01); *G09G 3/3406* (2013.01); *G09G 3/3607* (2013.01); (Continued)

(58) Field of Classification Search
CPC ..... G09G 2320/0646; G09G 2320/066; G09G 2320/0686; G09G 2330/021; G09G 2360/16; G09G 3/3426; G09G 3/3648
See application file for complete search history.

(56) References Cited

U.S. PATENT DOCUMENTS 7,436,415 B2 10/2008 Takata et al.
7,638,754 B2 12/2009 Morimoto et al.
(Continued)

FOREIGN PATENT DOCUMENTS

CN 101236728 8/2008
CN 101271208 9/2008
(Continued)

OTHER PUBLICATIONS

U.S. Appl. No. 15/185,537, filed Jun. 17, 2016, Zhang et al.
(Continued)

*Primary Examiner* — Michael J Jansen, II
*Assistant Examiner* — Sosina Abebe
(74) *Attorney, Agent, or Firm* — Harness, Dickey & Pierce, P.L.C.

(57) ABSTRACT

The disclosure provides an apparatus and method for controlling liquid crystal display brightness, and a liquid crystal display device, where the method includes: determining grayscale values of pixels in a zone image data block under a predetermined rule according to a received image signal; pre-obtaining a zone backlight value corresponding to the zone image data block according to the grayscale values in the zone image data block; multiplying the pre-obtained a zone backlight value with a backlight value gain coefficient to obtain a backlight value to which a gain is applied of a backlight zone, wherein the backlight value gain coefficient is more than 1; and mapping the respective zone backlight values to driver circuits of backlight sources in the corresponding backlight zones.

18 Claims, 16 Drawing Sheets

(52) U.S. Cl.
CPC ..... *G09G 3/3648* (2013.01); *G09G 2310/08* (2013.01); *G09G 2320/066* (2013.01); *G09G 2320/0626* (2013.01); *G09G 2320/0646* (2013.01); *G09G 2320/0686* (2013.01); *G09G 2330/021* (2013.01); *G09G 2360/16* (2013.01)

(56) References Cited

U.S. PATENT DOCUMENTS

| | | | | |
|---|---|---|---|---|
| 2004/0257329 | A1 | 12/2004 | Park et al. | |
| 2005/0057487 | A1* | 3/2005 | Takata | G09G 5/003 345/102 |
| 2005/0179639 | A1 | 8/2005 | Hsieh | |
| 2007/0001997 | A1* | 1/2007 | Kim | G09G 3/3406 345/102 |
| 2007/0030697 | A1 | 2/2007 | Kim | |
| 2007/0216636 | A1 | 9/2007 | Lo | |
| 2007/0222730 | A1 | 9/2007 | Kao et al. | |
| 2008/0055231 | A1 | 3/2008 | Nose et al. | |
| 2008/0180383 | A1 | 7/2008 | Lin et al. | |
| 2008/0186393 | A1 | 8/2008 | Lee et al. | |
| 2008/0245949 | A1* | 10/2008 | Morimoto | G01J 1/32 250/205 |
| 2008/0284719 | A1 | 11/2008 | Yoshida | |
| 2009/0066632 | A1 | 3/2009 | Chen | |
| 2009/0128583 | A1 | 5/2009 | Choi | |
| 2009/0167670 | A1 | 7/2009 | Peng et al. | |
| 2009/0189842 | A1 | 7/2009 | Huang et al. | |
| 2010/0020005 | A1 | 1/2010 | Jung et al. | |
| 2010/0066657 | A1 | 3/2010 | Park et al. | |
| 2010/0103089 | A1 | 4/2010 | Yoshida et al. | |
| 2010/0164922 | A1 | 7/2010 | Nose et al. | |
| 2010/0214330 | A1* | 8/2010 | Shishido | G09G 3/342 345/691 |
| 2010/0245397 | A1 | 9/2010 | Choe et al. | |
| 2011/0051161 | A1 | 3/2011 | Yen et al. | |
| 2011/0205442 | A1* | 8/2011 | Mori | G09G 3/3208 348/673 |
| 2011/0292018 | A1* | 12/2011 | Kubota | G09G 3/3426 345/211 |
| 2012/0249613 | A1 | 10/2012 | Takada et al. | |
| 2013/0265337 | A1 | 10/2013 | Furumoto et al. | |
| 2015/0009249 | A1 | 1/2015 | Kudo et al. | |
| 2015/0213781 | A1 | 7/2015 | Huang | |
| 2015/0339967 | A1 | 11/2015 | Shin | |
| 2016/0035285 | A1 | 2/2016 | Jung | |
| 2016/0284283 | A1 | 9/2016 | Kurita | |

FOREIGN PATENT DOCUMENTS

| | | | |
|---|---|---|---|
| CN | 101329458 | | 12/2008 |
| CN | 101383139 | | 3/2009 |
| CN | 101388183 | A | 3/2009 |
| CN | 101650921 | | 2/2010 |
| CN | 101673521 | | 3/2010 |
| CN | 201607919 | U | 10/2010 |
| CN | 102081258 | | 6/2011 |
| CN | 102137178 | A | 7/2011 |
| CN | 102243855 | | 11/2011 |
| CN | 102292757 | A | 12/2011 |
| CN | 102473383 | | 5/2012 |
| CN | 102568386 | | 7/2012 |
| CN | 102622990 | A | 8/2012 |
| CN | 102890918 | | 1/2013 |
| CN | 103050095 | | 4/2013 |
| CN | 103106875 | A | 5/2013 |
| CN | 103310765 | | 9/2013 |
| CN | 104050934 | | 9/2014 |
| CN | 104599642 | | 5/2015 |
| DE | 102008004281 | | 8/2008 |
| JP | 2002014660 | | 1/2002 |
| JP | 2008268798 | | 11/2008 |
| KR | 20070117847 | A * | 12/2007 |
| KR | 100809073 | | 3/2008 |
| KR | 20110066510 | | 6/2011 |
| WO | 2013166994 | | 11/2013 |

OTHER PUBLICATIONS

U.S. Appl. No. 15/185,682, filed Jun. 17, 2016, Zhang et al.
U.S. Appl. No. 15/158,759, filed May 19, 2016, Yang et al.
U.S. Appl. No. 15/158,702, filed May 19, 2016, Zhang et al.
U.S. Appl. No. 15/173,205, filed Jun. 3, 2016, Zhang et al.
U.S. Appl. No. 15/173,667, filed Jun. 5, 2016, Zhang et al.
U.S. Appl. No. 15/173,669, filed Jun. 5, 2016, Zhang et al.
Office Action from related Chinese Application No. 201510550060.5 dated Mar. 1, 2017 (11 pages).
Office Action from related Chinese Application No. 201510550060.5 dated Aug. 1, 2017 (10 pages).
Office Action from corresponding Chinese Application No. 201510592299.9 dated Apr. 13, 2017 (10 pages).
Office Action from corresponding Chinese Application No. 201510592299.9 dated Oct. 18, 2017 (3 pages).
Office Action from related Chinese Application No. 201510549986.2 dated Mar. 24, 2017 (11 pages).
Office Action from related Chinese Application No. 201510550065.8 dated Mar. 20, 2017 (13 pages).
Office Action from related Chinese Application No. 201510664843.6 dated Feb. 23, 2017 (8 pages).
Office Action from related Chinese Application No. 201510665186.7 dated Mar. 31, 2017 (10 pages).
Office Action from related Chinese Application No. 201510550126.0 dated Mar. 23, 2017 (15 pages).
Office Action from Chinese Application No. 201410267408.5 dated Jul. 10, 2017 (9 pages).
Office Action from Chinese Application No. 201510665186.7 dated Nov. 28, 2017 (5 pages).
U.S. Appl. No. 14/317,999, filed Jun. 27, 2014, Yuxin Zhang.
U.S. Appl. No. 14/317,021, filed Jun. 27, 2014, Yuxin Zhang.

* cited by examiner

-- Prior Art --

-- Prior Art --

-- Prior Art --

APPARATUS AND METHOD FOR CONTROLLING LIQUID CRYSTAL DISPLAY BRIGHTNESS, AND LIQUID CRYSTAL DISPLAY DEVICE

CROSS-REFERENCE TO RELATED APPLICATION

This application claims the benefit and priority of Chinese Patent Application No. 201510592299.9 filed Sep. 17, 2015. The entire disclosure of the above application is incorporated herein by reference.

FIELD

The present disclosure relates to the field of liquid crystal display technologies and particularly to an apparatus and method for controlling liquid crystal display brightness, and a liquid crystal display device.

BACKGROUND

This section provides background information related to the present disclosure which is not necessarily prior art.

A Liquid Crystal Display (LCD) device typically controls backlight brightness through dynamic backlight modulation to thereby save energy and improve the display contrast and other image quality-of-picture effects. As illustrated in FIG. 1 which is a structural principle diagram of dynamic backlight modulation in the liquid crystal display device in the prior art, the liquid crystal display device includes an image processing component configured to receive an input image signal, and to acquire backlight data as a function of grayscale brightness of the image signal, here on one hand, the image signal is converted in format according to the predetermined specification of a display panel, and output to a timing controller (TCON) in a liquid crystal display component, and a timing control signal and a data signal are generated by the timing controller to drive the liquid crystal panel; and on the other hand, the acquired backlight data are output to a backlight processing component, and the backlight data are converted by the backlight processing component into a backlight control signal to control a backlight driver component to control brightness of backlight sources in a backlight assembly so that if the brightness of the image is high, then the backlight source will be driven for high backlight brightness, and if the brightness of the image is low, then the backlight source will be driven for low backlight brightness.

SUMMARY

This section provides a general summary of the disclosure, and is not a comprehensive disclosure of its full scope or all of its features.

In an aspect, an embodiment of the disclosure provides an apparatus for controlling liquid crystal display brightness, the apparatus including a memory and one or more processors, herein one or more computer readable program codes are stored in the memory, and the one or more processors are configured to execute the one or more computer readable program codes to perform: determining grayscale values of pixels in a zone image data block under a predetermined rule according to a received image signal; pre-obtaining a zone backlight value corresponding to the zone image data block according to the grayscale values in the zone image data block; multiplying the pre-obtained zone backlight value with a backlight value gain coefficient to obtain a backlight value to which a gain is applied, of a backlight zone corresponding to the zone image data block, herein the backlight value gain coefficient is more than 1; and outputting the zone backlight value to a driver circuit of backlight source in the backlight zone.

In another aspect, an embodiment of the disclosure provides a method for controlling liquid crystal display brightness, the method including: determining grayscale value in a zone image data block under a predetermined rule according to a received image signal; pre-obtaining a zone backlight value corresponding to the zone image data block according to the grayscale value in the zone image data block; multiplying the pre-obtained zone backlight value with a backlight value gain coefficient to obtain a backlight value to which a gain is applied, of a backlight zone corresponding to the zone image data block, herein the backlight value gain coefficient is more than 1; and outputting the zone backlight value to a driver circuit of backlight source in the backlight zone.

In a further aspect, an embodiment of the disclosure provides a liquid crystal display device including: a memory configured to store programs and various preset lookup table data; an apparatus for controlling liquid crystal display brightness configured to execute the programs in the memory, and to invoke the various lookup table data according to the executed programs; to receive an image signal, to process the data, and to output the image data to a timing controller so that the timing controller generates a driver signal according to the image data to control a liquid crystal panel to display the image; and to output zone backlight values to a backlight processing component according to the image signal; the backlight processing component configured to determine duty ratios of corresponding PWM signals according to the respective zone backlight values, and to output the duty ratios to a PWM driver component; and the PWM driver component configured to generate PWM control signals to control backlight sources in corresponding zones; herein the apparatus for controlling liquid crystal display brightness is the apparatus above for controlling liquid crystal display brightness.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts or features throughout the several views of the drawings.

DETAILED DESCRIPTION

Example embodiments will now be described more fully with reference to the accompanying drawings.

Dynamic backlight modulation generally includes zoned backlight modulation and global backlight modulation, here in the global backlight modulation, the backlight brightness is controlled by acquiring the average brightness over one frame of image so that the real backlight brightness is determined by the average grayscale value across the frame of image, so the resulting backlight brightness will be maximized as a result of driving if the average grayscale value over the image is maximized (i.e., the all-white image), and in order to guarantee the reliability of the backlight source in operation, the maximized backlight brightness is typically controlled below rated brightness of the backlight source in operation. Typically in a normally displayed picture, the average grayscale brightness across the entire dynamic video picture can be statistically known at around 50% IRE, so that the average value of the backlight brightness will be around 50% of the maximized backlight brightness. Thus the real average power of the backlight source operating with global backlight modulation is controlled around half the rated power, and there is some apparent effect of saving energy. However in global backlight modulation, the average grayscale brightness across one or more consecutive frames of image is acquired, and global backlight source brightness is controlled by the average grayscale brightness of the image(s), but the average grayscale brightness of the image(s) may not reflect brightness details between local pictures of the images, and a variation in contrast of the image(s) will be more reflected in the difference in brightness between the local pictures of the images, and thus may not significantly improve the quality-of-picture effect for the display contrast.

Figure 1:
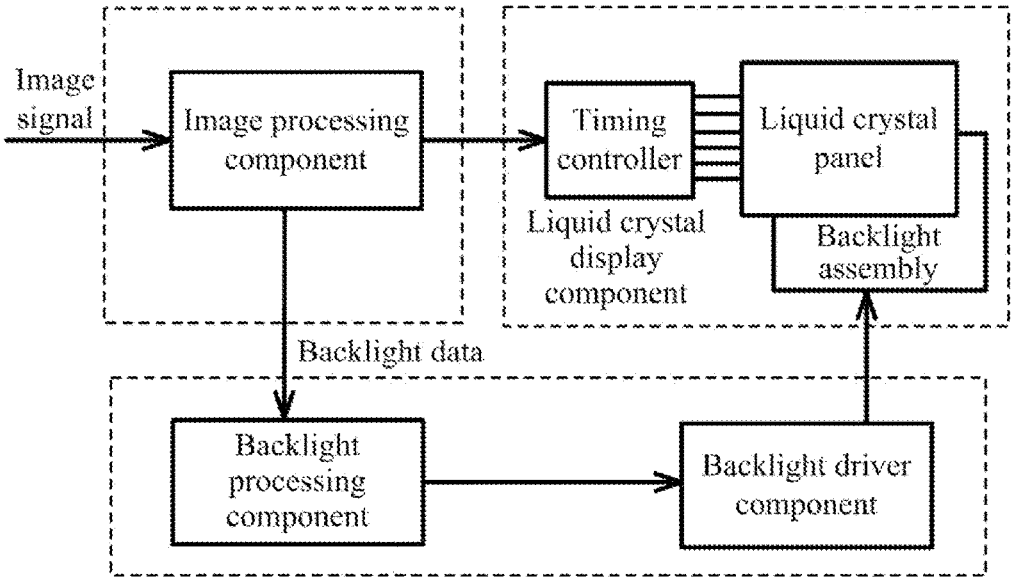
FIG. 1 is a structural principle diagram of dynamic backlight modulation in the liquid crystal display device in the prior art.
Figure 2:
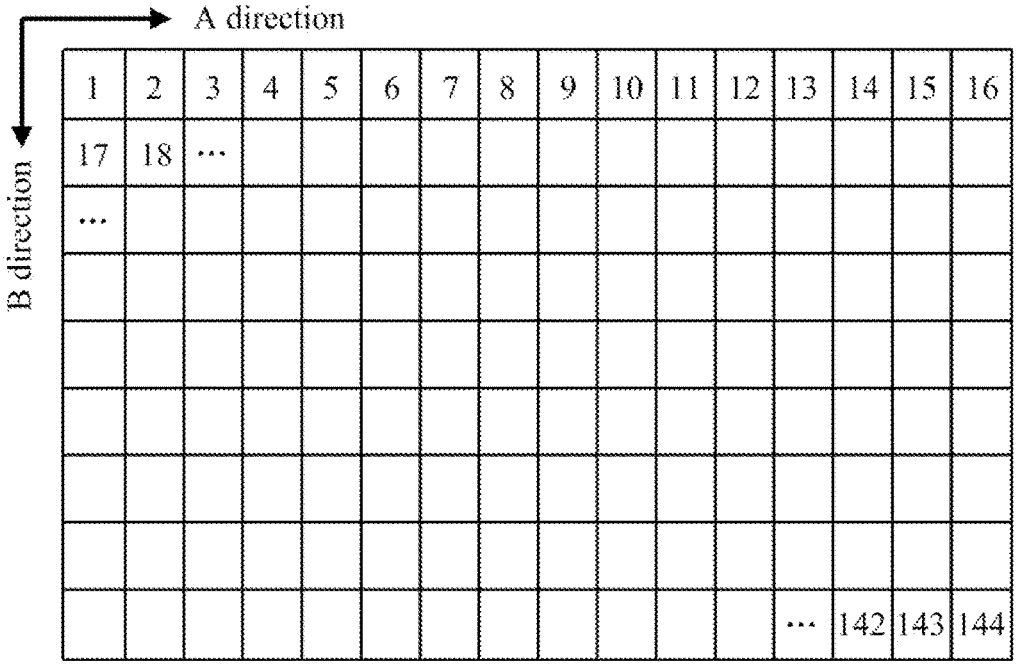
FIG. 2 is a schematic diagram of backlight zones in zoned dynamic backlight modulation in the prior art.

With zoned dynamic backlight modulation, as illustrated in FIG. 2 which is a schematic diagram of backlight zones in zoned dynamic backlight modulation in the prior art, the entire matrix of backlight sources includes M zones in the direction A and N zones in the direction B, and as illustrated, if M=16 and N=9, then there will be M*N=144 backlight zones in total, in each of which the backlight source brightness can be controlled separately as a result of driving, here it shall be noted that if the backlight zones are idealized, then the respective backlight zones can illuminate their backlight areas separately, but in fact, the brightness of the adjacent backlight sources may be affected somewhat. In zoned dynamic backlight modulation, each frame of global image is segmented into a number of zone image data blocks corresponding to the backlight zones, and grayscale data in the respective zone image data blocks are acquired to obtain the backlight data of the corresponding backlight zones, and the obtained backlight data of the respective zones reflect the differences in brightness between the corresponding zone image data blocks, so that the backlight brightness of the backlight zones will be determined by the brightness of the image data blocks corresponding to the backlight zones, and the variations in backlight brightness of the zones will reflect the grayscale brightness in the zone image data blocks in which area pictures need to be displayed, and highlight the differences in display brightness between the local pictures of the displayed image, thus improving the contrast quality-of-picture effect of the dynamic image.

Figure 3:
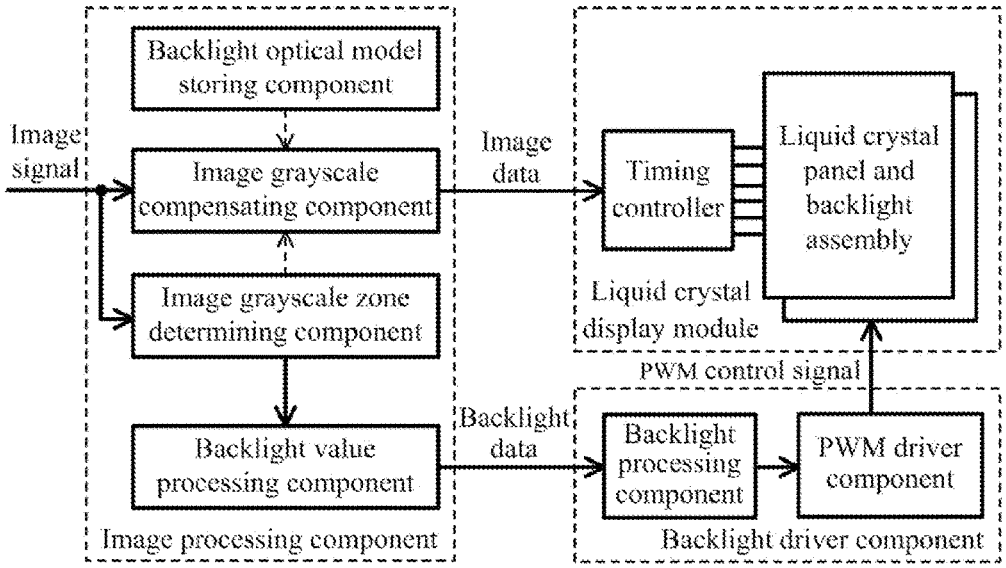
FIG. 3 is a structural diagram of obtaining the backlight values of the zones in zoned dynamic backlight modulation in the prior art.

In the prior art, the backlight values of the backlight data of the image are acquired in zoned dynamic backlight modulation as illustrated in FIG. 3 here an image processing component receives an input image signal, and on one hand, an image grayscale zone determining component is configured to determine a brightness grayscale of each image pixel in a zone image data block in the image signal, and a backlight value processing component is configured to obtain a backlight value of the zone from a determination result, here the backlight value can be obtained particularly as the maximum value, the average value, the average value of weighted values, the weighted value of average values, etc.; and on the other hand, in order to compensate for a difference in display brightness of the image arising from different backlight brightness in the different backlight zones, an image grayscale compensating component can further perform a predetermined image data grayscale compensation algorithm on the backlight value in each backlight zone according to a preset function relationship in a backlight optical model storing component, and obtain and output compensated image data to a timing controller to drive the liquid crystal panel to display the image. Particularly in the algorithm above for obtaining the backlight values, for example, if the image grayscale of each image pixel ranges from 0 to 255, then the backlight value of the zone will be obtained as any one value from 0 to 255; and then a backlight processing component receives and then converts directly the any one backlight value from 0 to 255 into a PWM backlight drive signal to drive the backlight sources in the zone, here the backlight source is driven by the maximum backlight value of 255 accordingly for the maximum backlight brightness, and the backlight source is driven by any other backlight value between 0 and 255 for lower peak brightness than the maximum backlight brightness. As can be known from an analysis thereof, the index of picture contrast is determined by the maximum peak brightness and the minimum display brightness, i.e., the ratio of display brightness of a picture at the display grayscale value of 255 to display brightness of a picture at the display grayscale value of 0, but the brightness of the picture at the display grayscale value of 0 is typically predetermined and hardly influenced by the backlight brightness, so the maximum peak brightness is a predominating factor of the index of displayed picture contrast. As can be known from the analysis above, since the backlight peak brightness of each zone is limited to the maximum backlight value of 255, if the maximum peak brightness of the respective zones is limited to the maximum backlight value of 255, then an improvement to the contrast of the displayed picture may be discouraged.

In a method and apparatus for controlling liquid crystal display brightness, and a liquid crystal display device according to some embodiments of the disclosure, on one hand, pre-obtained zone backlight values are calculated from grayscale values in zone image data blocks, and then a preset backlight gain coefficient is obtained, and the pre-obtained zone backlight values are multiplied respectively with the preset backlight gain coefficient to obtain the zone backlight values to which a gain is applied, so that the zone backlight values to which the gain is applied are output to drive backlight sources in respective backlight zones to thereby improve the backlight peak brightness so as to further improve the dynamic contrast of the displayed image.

On the other hand, in some preferred embodiments of the disclosure, a revision coefficient is added, here it is determined from the average grayscale brightness of the image whether the image includes a large-area dark scene as a whole, and if so, then the zone backlight values to which the gain is applied will be revised, here the revision coefficient is determined as a function of dispersity of image brightness distribution, so that in the disclosure, given the enhanced backlight peak brightness, if the average brightness of the image is below some threshold, then it will indicate that pictures of the image include a dark scene, and if the brightness distribution dispersity of the image is high, then the amplitude of the backlight gain will be lowered; and if the average brightness of the image is above some threshold, then it will indicate that the pictures of the image include no large-area dark scene, so an influence of halo upon the image, and the amplitude of the backlight gain thereof will not be lowered, or will be insignificantly lowered, while guaranteeing the backlight peak brightness.

In order to improve the effect of a dynamic contrast quality-of-picture of a displayed image in a liquid crystal display device, zoned dynamic backlight modulation is applied so that the entire matrix of backlight sources thereof is divided into a number of backlight zones in row and column directions, and the backlight sources in each backlight zone can be driven separately to drive brightness thereof, here it shall be noted that if the backlight zones are idealized, then the respective backlight zones can illuminate separately their backlight zones, but in fact, the brightness of the adjacent backlight sources may be affected somewhat. Image grayscale brightness of zone image data blocks displayed on a liquid crystal display panel corresponding to the backlight zones is acquired, backlight values of the backlight zones are obtained as a function of the image grayscale brightness in an algorithm of obtaining the backlight values, and the backlight sources in the zones are driven by the backlight values to emit light so as to provide desirable backlight brightness for the image in the zones to be displayed. It shall be noted that the zone image data blocks refer to that the liquid crystal display panel is zoned uniformly under a uniform backlight zoning rule, and image data of all the pixels displayed in the display zones of the liquid crystal panel at the same positions as the backlight zones are aggregated, here the backlight zones may not overlap completely with the boundaries of the areas displayed on the liquid crystal panel corresponding to the zone image data blocks due to a design error and a process error, and it shall be further noted that the backlight zones, and the zones of the liquid crystal panel relate to virtual boundaries instead of physical boundaries in a real design.

However as can be apparent from the analysis in the Background section, in order to address the drawback in the algorithm of obtaining the backlight value in the prior art, and to further improve the effect of the contrast quality-of-picture of the image displayed on the liquid crystal display device with controlled zoned dynamic backlight, the disclosure proposes a method and apparatus for controlling liquid crystal display brightness, and a liquid crystal display device.

All the embodiments of the disclosure relate to an 8-bit (28=256 grayscales) liquid crystal display screen by way of an example.

Figure 4:
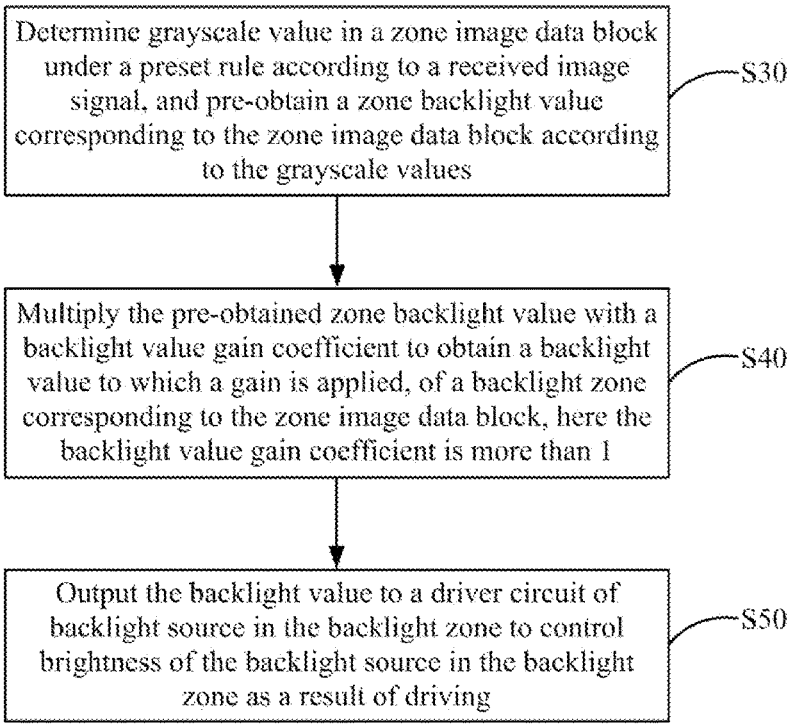
FIG. 4 is a schematic flow chart of a method for controlling liquid crystal display brightness according to a first embodiment of the disclosure.

FIG. 4 is a schematic flow chart of a method for controlling liquid crystal display brightness according to an embodiment of the disclosure. As illustrated in FIG. 4, an executor of this embedment can be an image processing device in which processing and storing functions are integrated. The image processing device can be a single video processing chip, or consisted of a number of video processing chips cooperating with each other, and can be arranged in a liquid crystal display device with controlled zoned dynamic backlight, here the liquid crystal display device can be a liquid crystal TV set, a liquid crystal display, a tablet computer, etc.; and with this method, backlight values for driving brightness of backlight sources in respective backlight zones are generated for an input image signal to improve the effect of display contrast of an image as a whole, and the method for controlling liquid crystal display brightness includes:

The operation S30 is to determine grayscale values in a zone image data block under a predetermined rule according to a received image signal, and to pre-obtain a zone backlight value corresponding to the zone image data block according to the grayscale values.

In this embodiment, the predetermined rule can be a pre-stored function model in which a liquid crystal panel is divided into a number of virtual zones at the same proportion as the backlight zones, and image data of all pixels displayed in one of the virtual zones are aggregated into a zone image data block.

Particularly the zone backlight value of each zone image data block is pre-obtained from the grayscale values of the pixels in a backlight zone corresponding to the zone image data block in a predetermined algorithm, here the pre-obtained zone backlight value is not finally used to drive the backlight sources, but a gain will be further applied to the pre-obtained zone backlight value and/or the pre-obtained zone backlight value will be adjusted, thus resulting in a final backlight value.

It shall be noted that the predetermined algorithm can be an algorithm of averaging the grayscales of all pixels, or can be an algorithm of averaging the maximum values of red, green, and blue sub-pixels in the respective pixels, or can be an algorithm of averaging their weighted grayscales, here weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of the disclosure will not be limited thereto.

By way of an example, a matrix of backlight sources in the liquid crystal display device is divided into 16 zones in the row direction and 9 zones in the column direction, so that the entire matrix of backlight sources are divided into 144 backlight zones, in each of which the backlight sources can be driven separately to control brightness, here the brightness can be controlled through current or PWM-controlling, and the backlight sources can be LED backlight sources. The resolution of the liquid crystal display panel in the liquid crystal display device is 3840*2160, and accordingly there are 16*9 virtual zones on the liquid crystal display panel under a backlight zoning rule. As per the positions here the virtual zones of the image data on the liquid crystal display panel are displayed, the image data are segmented into 16*9 zone image data blocks according to the preset function model, here each zone image data block includes 240*240 pixels, so the 240*240 pixels in each zone image data block are displayed on one virtual zone of the display panel at display brightness controlled by the backlight sources in the corresponding backlight zone. Then grayscale values of the 240*240 pixels in the one zone image data block are determined, the average of the grayscale values of the zone image data block is obtained as 160 in the predetermined backlight algorithm, and the pre-obtained zone backlight value of the corresponding backlight zone is obtained as 160; and the pre-obtained zone backlight values of the other backlight zones are obtained similarly.

It shall be noted that the backlight zone may not overlap completely with the boundary of the area displayed on the liquid crystal panel corresponding to the zone image data block due to a design error and a process error, or taking into account a design demand and other factors, that is, the real number of pixels in the zone image data block may be more than 240*240, so that there may be pixels overlapping between the adjacent zone image data blocks.

The operation S40 is to multiply the pre-obtained zone backlight value with a backlight value gain coefficient to obtain a zone backlight value to which a gain is applied, of the backlight zone, here the backlight value gain coefficient is more than 1.

In this embodiment, the zone backlight values of all the backlight zones are pre-obtained respectively as described in the operation S30 here the zone backlight values are pre-obtained, and then the zone backlight values are multiplied respectively with the backlight value gain coefficient to obtain the backlight values to which the gain is applied, of the backlight zones. Since the preset backlight value gain coefficient is more than 1, the backlight values to which the gain is applied, of the respective backlight zones, as a result of the multiplication, are more than the pre-obtained zone backlight values, so that zone peak brightness can be improved by driving the backlight of the zones using the backlight values to which the gain is applied, and as can be apparent from the analysis in the Background section, the zone peak brightness can be improved to thereby enhance the contrast of displayed pictures of the image.

It shall be noted that those skilled in the art can select the particular value of the backlight gain coefficient as needed for the design, for example, if the backlight gain coefficient is taken as 1.5, then each zone backlight value will be pre-obtained and multiplied respectively with the backlight gain coefficient of 1.5, or if the backlight gain coefficient is taken as 2, then each zone backlight value will be pre-obtained and multiplied respectively with the backlight gain coefficient of 2. In order to ensure the reliability of the backlight sources being lightened, it will not be appropriate for the amplitude of the gain to be two large, and the parameter can be selected by those skilled in the art without any inventive effort.

By way of an example, as in the operation S30, a zone backlight value is pre-obtained as 160 in any backlight zone, and multiplied with a backlight value gain coefficient of 2 to obtain the backlight value to which the gain is applied, of the backlight zone, as 320, so that the backlight value to which the gain is applied can be improved significantly, and the peak brightness of the backlight zone can be improved significantly by driving the backlight sources of the backlight zone using the backlight value to which the gain is applied, thus enhancing the effect of the contrast quality of picture.

In this embodiment, the backlight value gain coefficient can be some defined value more than 1 for all image frames, so that the backlight value gain coefficient will be the same for the backlight value of each backlight zone in displayed pictures of a frame of image, and also the same for different frames of images, so the same backlight value gain coefficient will apply to all the backlight zones in all the frames of images.

Furthermore in another embodiment of the disclosure, the backlight gain coefficient can be obtained particularly by presetting a lookup table.

First Implementation

Figure 6A:
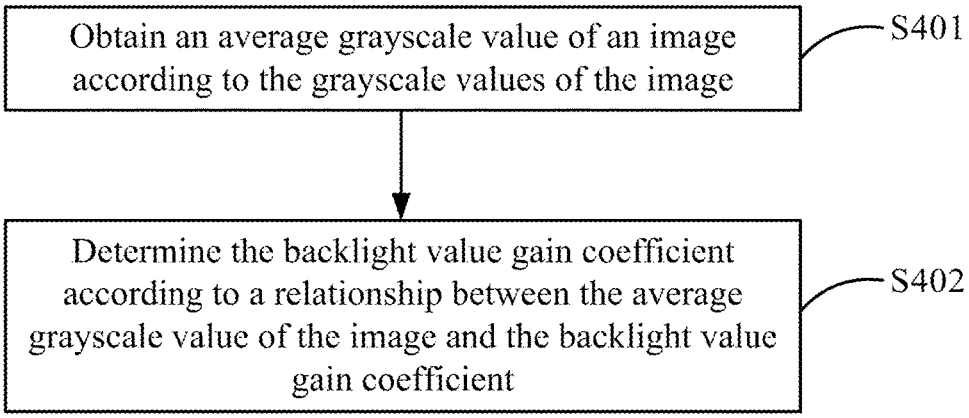
FIG. 6A is a schematic flow chart of obtaining a preset backlight gain coefficient according to the first embodiment of the disclosure.

As illustrated in FIG. 6A which is a schematic flow chart of obtaining a backlight gain coefficient according to a first embodiment of the disclosure, the flow particularly includes:

The operation S401 is to obtain an average grayscale value of a global image according to grayscale values of the image.

Figure 5A:
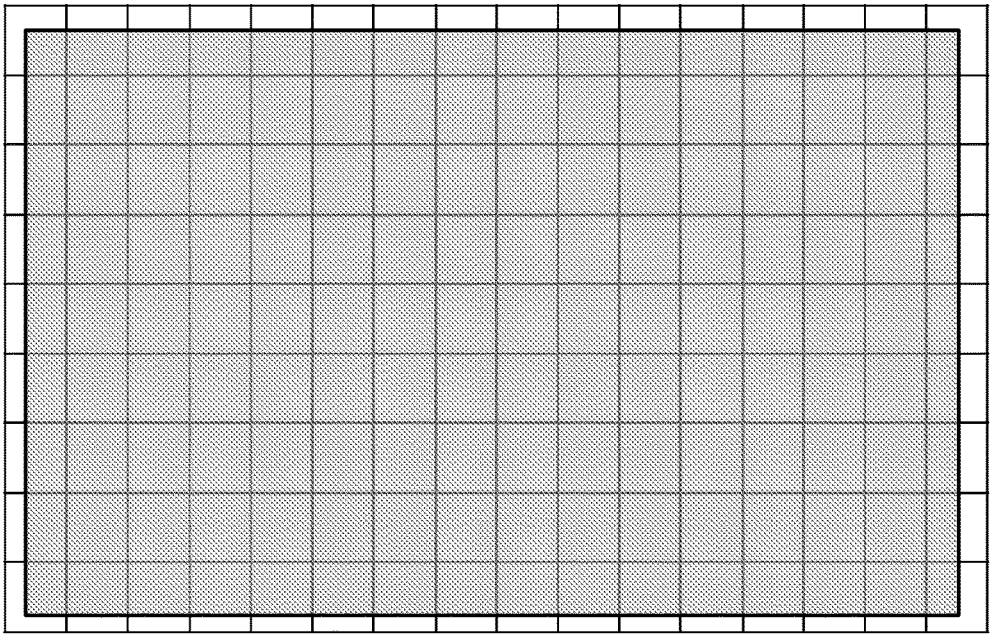
FIG. 5A is a schematic diagram of a display area segmented into image data blocks according to the first embodiment of the disclosure.

By way of an example, as illustrated in FIG. 5A, which is a schematic diagram of a display area segmented into image data blocks according to the first embodiment of the disclosure, together with FIG. 2, alike the display panel is divided into 144 virtual zones under the backlight zoning rule, the global image displayed at the corresponding position on the display panel is segmented into 144 zone image data blocks, grayscale values of all pixels in each zone image data block are obtained respectively, and then an average of the grayscale values is obtained in the preset algorithm, which can be an algorithm of averaging the grayscales of all pixels, or can be an algorithm of averaging the maximum values of red, green, and blue sub-pixels in the respective pixels, or can be an algorithm of averaging their weighted grayscales, here weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of the disclosure will not be limited thereto.

It shall be noted that in the preset algorithm, an average grayscale value of each of zone image data blocks can be calculated according to firstly the operation S30, and then an average grayscale value of all the zone image data blocks can be obtained according to the average grayscale value of each of zone image data blocks so as to obtain an average grayscale value of the global image.

Stated otherwise, firstly the grayscale values of all the pixels in the global image can be obtained, and then the average grayscale value of the global image can be obtained from the grayscale values of all the pixels in the preset algorithm.

The operation S402 is to determine the backlight value gain coefficient according to a relationship between the average grayscale value of the global image and the backlight value gain coefficient.

Particularly a backlight value gain coefficient lookup table needs to be pre-stored, in which the correspondence relationship between the average grayscale value of the global image and the backlight value gain coefficient is recorded, here the gain coefficient is obtained from the average grayscale value of the image; and there are 256 grayscale values in total from 0 to 255 on the transverse axis, and each grayscale value corresponds respectively to a backlight value gain coefficient. The lookup table is searched for the backlight value gain coefficient corresponding to the average grayscale value of the image using the average grayscale value of the image.

Figure 7A:
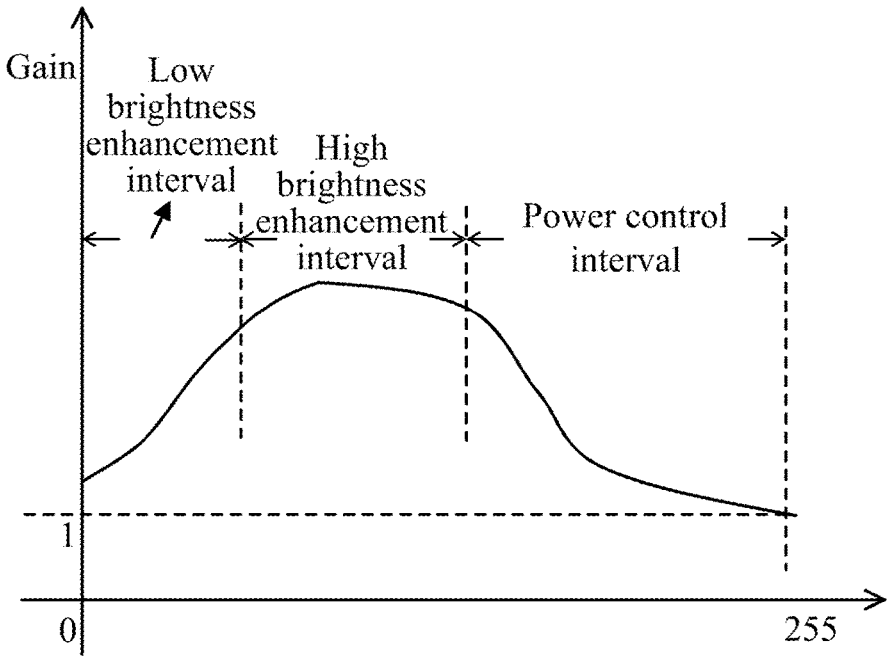
FIG. 7A is a schematic diagram of a backlight value gain curve according to the first embodiment of the disclosure.

By way of an example, as illustrated in FIG. 7A which is a schematic diagram of a backlight value gain curve according to the first embodiment of the disclosure, the gain curve can be particularly divided into a low brightness enhancement interval, a high brightness enhancement interval, and a power control interval while the average grayscale value of the image is increasing, here the gain coefficient in the high brightness enhancement interval is more than those in the low brightness enhancement interval and the power control interval respectively. If the grayscale value of the global image is low, e.g., the average grayscale value ranges from 0 to 100, then it will lie in the low brightness enhancement interval, and the gain coefficient will increase with the increasing brightness of the global image, here if the brightness of the global image is low, then the gain coefficient will approach 1, and the amplitude of the backlight value gain will be low; and as the brightness of the global image is increasing, the gain coefficient will be increasing, and the amplitude of the backlight value gain will also be increasing. If the grayscale value of the global image is further increasing, for example, the average grayscale value ranges from 100 to 200, then it will lie in the high brightness gain interval; and since the corresponding brightness of the grayscale of the image in the high brightness gain interval is intermediate, there will be a lot of hierarchal details of the image, and the amplitude of the gain will be large, thus highlighting the sense of hierarchy in the pictures, here the maximum value of the gain coefficient lies in the high brightness gain interval, and particularly the particular parameters for the position of the maximum value of the gain coefficient on the curve, and the particular data thereof can be selected by those skilled in the art without any inventive effort. If the brightness of the global image is very high, for example, the average grayscale value ranges from 200 to 255, then since the overall brightness of the image is high, the brightness of the image is substantially saturated, the details of the image become less, and the brightness of the entire pictures in the backlight area is sufficiently high, so that human eyes become less sensitive to the high brightness of the image in this area, and thus it will be substantially unnecessary to further enhance the brightness of backlight, and on the contrary, power consumption will be controlled by lowering the amplitude of the backlight gain. Accordingly the gain coefficient will become less while the average grayscale value of the global image is further increasing.

It shall be noted that in this embodiment, the backlight value gain coefficient corresponds to the average grayscale value of the global image in each frame of image in a one-to-one manner, and the average grayscale value of a frame of global image is uniquely determined in the predetermined algorithm, here the determined average grayscale value corresponds to a determined backlight gain coefficient. While a frame of pictures is being displayed, all the backlight values of the respective backlight zones are multiplied with the same backlight value gain coefficient. However for typically sequentially displayed moving pictures, different average grayscale values will be obtained for different frames of images, so the different frames of image will correspond to different backlight value gain coefficients. As can be apparent from the analysis above, the different backlight gain coefficients will result in different gain amplitudes of backlight brightness, that, different gain amplitudes of backlight will be generated as a function of the changing image to thereby improve the dynamic contrast of the displayed pictures and control the power consumption of the backlight sources.

Second Implementation

Figure 6B:
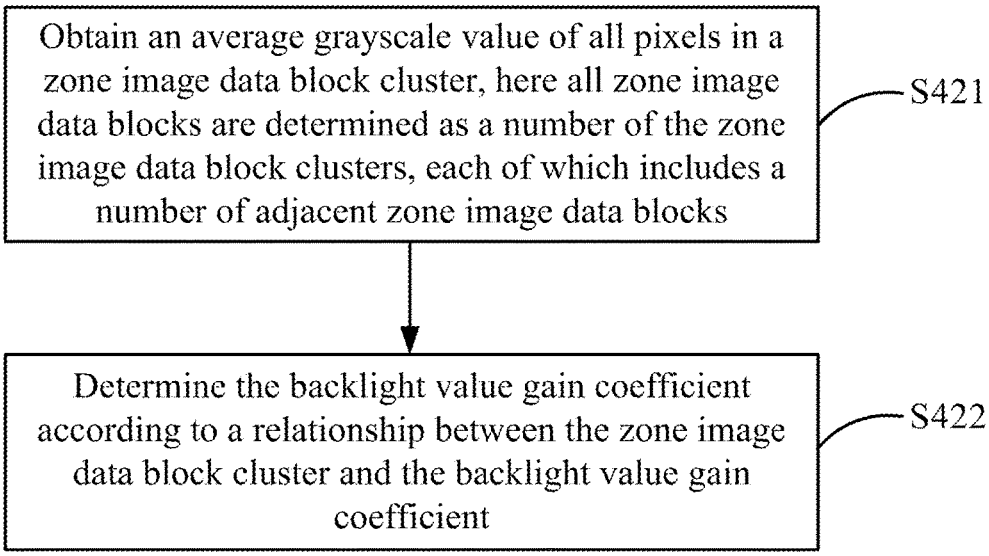
FIG. 6B is another schematic flow chart of obtaining a backlight gain coefficient according to the first embodiment of the disclosure.

As illustrated in FIG. 6B which is another schematic flow chart of obtaining a backlight gain coefficient according to the first embodiment of the disclosure, the flow particularly includes:

The operation S421 is to obtain an average grayscale values of all pixels in a zone image data block cluster, here all zone image data blocks are determined as a number of the zone image data block clusters, each of which includes a number of adjacent zone image data blocks.

By way of an example, as illustrated in FIG. 2, the entire matrix of backlight sources is divided into 16*9=144 backlight zones under the backlight zoning rule here there are 16 zones in the row direction and 9 zones in the column direction. The display area of the display panel is divided correspondingly into 16*9=144 virtual zones under the backlight zoning rule, here a zone image data block includes display image data aggregated in each virtual zone of the display panel, so a frame of image data is segmented correspondingly into 16*9=144 zone image data blocks.

Figure 5B:
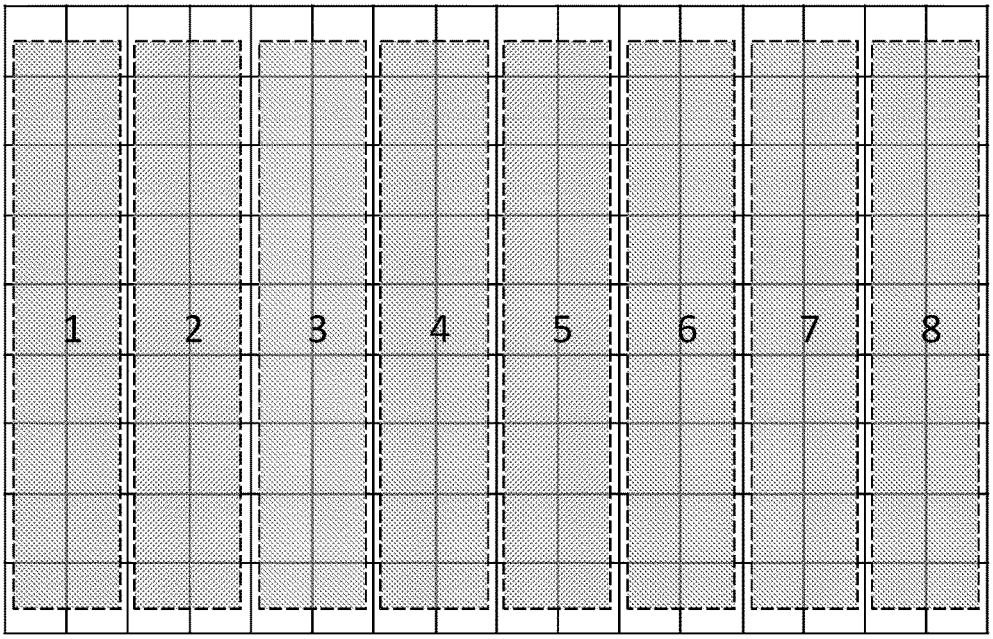
FIG. 5B is a schematic diagram of clusters into zone image data blocks are segmented according to the first embodiment of the disclosure.
Figure 5C:
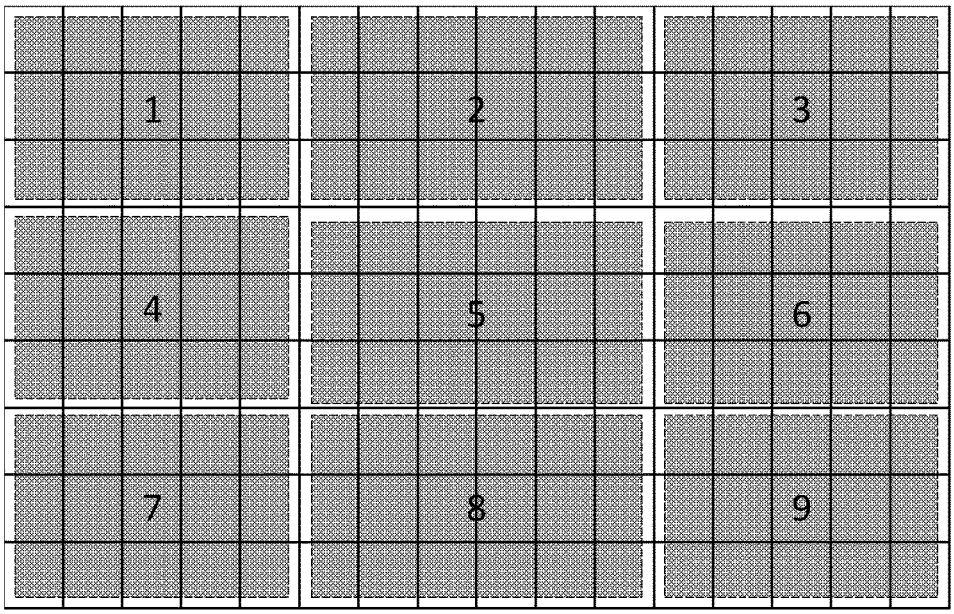
FIG. 5C is another schematic diagram of clusters into zone image data blocks are segmented according to the first embodiment of the disclosure.

As illustrated in FIG. 5B which is a schematic diagram of clusters into zone image data blocks are segmented according to the first embodiment of the disclosure, here every two columns are a cluster of zone image data blocks, and each zone image data block cluster includes 2*9=18 zone image data blocks, thus resulting in 8 zone image data block clusters in total. It shall be noted that a zone image data block cluster refers to aggregated data of all pixels in a number of adjacent zone image data blocks, and particularly the zone image data blocks are divided into the clusters under a rule which can be determined as required for the design, for example, they are evenly divided into 8 clusters in the column direction as illustrated in FIG. 5B, and in another example, they are divided into 9 clusters in both the row direction and the column direction as illustrated in FIG. 5C.

Grayscale values of all pixels in each cluster of zone image data blocks is obtained respectively, and then an average grayscale value is obtained in a preset algorithm which can be an algorithm of averaging the grayscales of all pixels, or an algorithm of averaging the maximum values of red, green, and blue sub-pixels in the respective pixels, or an algorithm of averaging their weighted grayscales, here weight coefficients thereof can be preset; and those skilled in the art can devise other particular algorithms of obtaining the backlight values without any inventive effort, and the backlight data of the zones can be obtained in alternative algorithms in this embodiment and other embodiments, so the embodiments of the disclosure will not be limited thereto.

It shall be noted that in the preset algorithm, average grayscale values of the respective zone image data blocks can be calculated according to firstly the operation S30, and then an average grayscale value of all the zone image data blocks in a zone image data block cluster according to the average grayscale values of the respective zone image data blocks so as to obtain an average grayscale value of the zone image data block cluster.

Stated otherwise, firstly grayscale values of all pixels in each of zone image data block clusters can be obtained, and then an average grayscale value of all zone image data block clusters can be obtained from the grayscale values of all the pixels in the preset algorithm.

The operation S422 is to determine the backlight value gain coefficient according to a relationship between the zone image data block cluster and the backlight value gain coefficient.

In this embodiment, a number of gain coefficient lookup tables are preset, and there are at least two zone image data block clusters corresponding to different lookup tables in which different relationships between the backlight value gain coefficient and the average grayscale value are recorded. The backlight value gain coefficient lookup tables need to be pre-stored, in each of which the correspondence relationship between the average grayscale value and the backlight value gain coefficient is recorded, here the average grayscale value is mapped to the gain coefficient; and there are 256 grayscale values in total from 0 to 255 on the transverse axis, and each grayscale value corresponds respectively to a backlight value gain coefficient. The lookup table is searched for the backlight value gain coefficient corresponding to the average grayscale value of the image using the average grayscale value of the image.

Figure 7B:
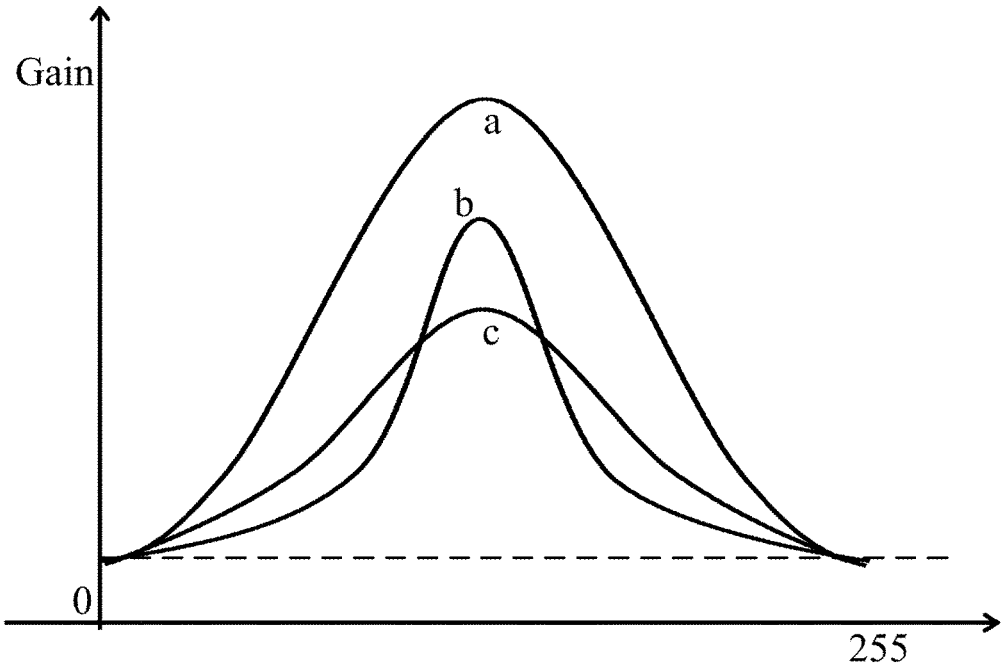
FIG. 7B is a schematic diagram of another backlight value gain curve according to the first embodiment of the disclosure.

By way of an example, as illustrated in FIG. 7*b* which is a schematic diagram of another backlight value gain curve according to the first embodiment of the disclosure, there are a number of gain curves in FIG. 7*b*, here a zone image data block cluster corresponds to a gain curve, and there are at least two zone image data block clusters corresponding to different gain curves. A gain coefficient lookup table is matched to the position here a zone image data block cluster is distributed on a display area, and referring to FIG. 5B, the zone image data block clusters 1 and 8 correspond to the gain curve c, the zone image data block clusters 2 and 7 correspond to the gain curve b, and the zone image data block clusters 3, 4, 5 and 6 correspond to the gain curve a; and further referring to FIG. 5C, the zone image data block clusters 1, 3, 7 and 9 correspond to the gain curve c, the zone image data block clusters 2, 4, 6 and 8 correspond to the gain curve b, and the zone image data block cluster 5 corresponds to the gain curve a.

The gain curves a, b and c are recorded in the different lookup tables to represent different relationships between a backlight gain coefficient and an average grayscale, here the intermediate brightness gain coefficient in the gain curve a is larger than in the gain curves b and c, and the intermediate brightness gain coefficient in the gain curve b is larger than in the gain curve c. In other words, the general center of an angle of view at which a user is watching a displayed picture is positioned at the center of the displayed image, and the details of the displayed image, and the display focus are located at the center of the display area in order to highlight the effect of the contrast of the picture in the central area, so that a gain curve with a larger gain amplitude, e.g., the gain curve a, will be applied to a zone image data block cluster located in the central area of the displayed image, and a gain curve with a smaller gain amplitude, e.g., the gain curve b or c, will be applied to a zone image data block cluster located remote from the central area of the displayed image.

FIG. 7B shows a similar trend of the varying curves to those in FIG. 7A, here each gain curve can be particularly divided into a low brightness enhancement interval, a high brightness enhancement interval, and a power control interval while the average grayscale value is increasing, here gain coefficients in the high brightness enhancement interval are more than those in the low brightness enhancement interval and the power control interval respectively (not illustrated in FIG. 7B and particularly referring to FIG. 7A). If the grayscale brightness is low, e.g., the average grayscale value ranges from 0 to 100, then it will lie in the low brightness enhancement interval, and the gain coefficient will increase with the increasing grayscale brightness, here if the grayscale brightness is low, then the gain coefficient will approach 1, and the amplitude of the backlight value gain will be low; and as the grayscale brightness is increasing, the gain coefficient will be increasing, and the amplitude of the backlight value gain will also be increasing. If the grayscale brightness is further increasing, for example, the average grayscale value ranges from 100 to 200, then it will lie in the high brightness gain interval; and since the corresponding grayscale brightness of the image in the high brightness gain interval is intermediate, there will be a lot of hierarchal details of the image, and the amplitude of the gain will be large, thus highlighting the sense of hierarchy in the pictures, here the maximum value of the gain coefficient lies in the high brightness gain interval, and particularly the particular parameters for the position of the maximum value of the gain coefficient on the curve, and the particular data thereof can be selected by those skilled in the art without any inventive effort. If the brightness of the grayscale brightness in the area is very high, for example, the average grayscale value ranges from 200 to 255, then since the overall brightness of the image in the area is high, the brightness of the image is substantially saturated, the details of the image become less, and the brightness of the entire pictures in the backlight area is sufficiently high, so that human eyes become less sensitive to the high brightness of the image in this area, and thus it will be substantially unnecessary to further enhance the brightness of backlight, and on the contrary, power consumption will be controlled by lowering the amplitude of the backlight gain. Accordingly the gain coefficient will become less while the average grayscale value is further increasing.

It shall be noted that in this embodiment, the backlight value gain coefficient corresponds to an average grayscale value of all pixels in the area covered by each of zone image data block clusters in a one-to-one manner, and the average grayscale value of all the pixels in the area is uniquely determined in the predetermined algorithm, here the determined average grayscale value corresponds to a determined backlight gain coefficient. While a frame of pictures is being displayed, all the backlight values of the respective backlight zones in the same zone image data block cluster are multiplied with the same backlight value gain coefficient. However the different zone image data block clusters can correspond to different backlight value gain coefficients, and the different backlight gain coefficients will result in different gain amplitudes of backlight brightness, so that different gain amplitudes of backlight will be generated as a function of the changing image to thereby improve the dynamic contrast of the displayed pictures and control the power consumption of the backlight sources.

The operation S50 is to output the respective zone backlight values to driver circuits of backlight sources in the corresponding backlight zones to control the brightness of the backlight sources in the corresponding backlight zones as a result of driving.

Figure 9:
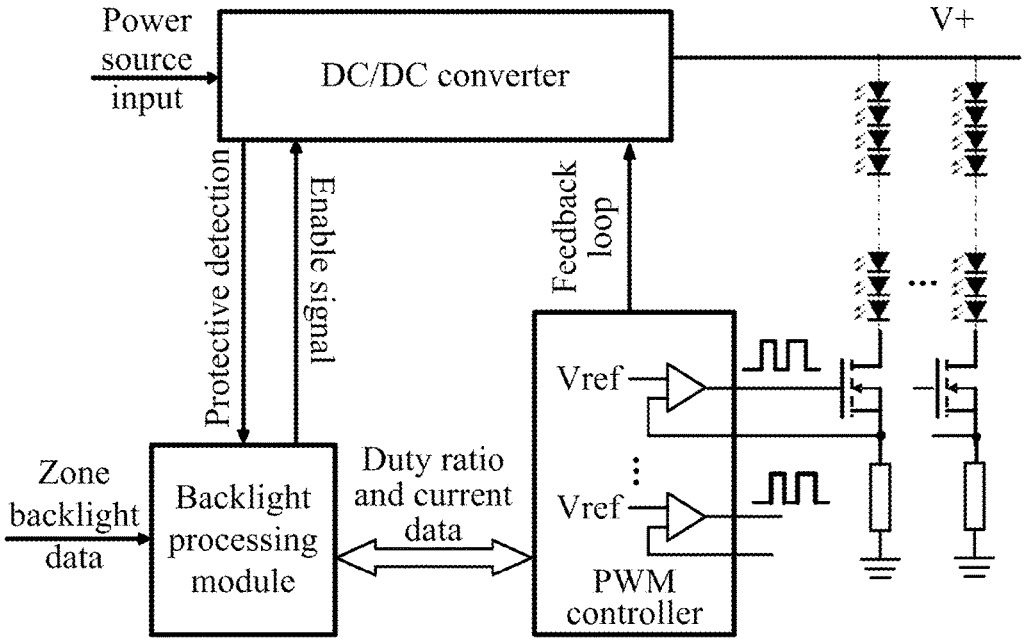
FIG. 9 is a structural diagram of a backlight source driver according to the first embodiment of the disclosure.

In some embodiments of the disclosure, as illustrated in FIG. 9 which is a structural diagram of the backlight source driver in the first embodiment of the disclosure, the backlight processing component outputs the respective zone backlight values to which the gain is applied, to the driver circuits of the backlight sources in the respective backlight zones, and determines duty ratios of corresponding PWM signals according to the backlight data of the respective zones, here if the backlight data are a brightness value ranging from 0 to 255, then the duty ratio of the PWM signal will become larger as the brightness value is increasing, and the backlight processing component sends the determined duty ratios of the PWM signals to PWM controllers corresponding to the real backlight elements, and the PWM controllers output control signals as a function of the duty ratios to the real backlight elements to control MOS transistors connected with strings of LED lamps to be switched on and off so as to control the real backlight elements to generate brightness corresponding to the backlight data. When the PWM controllers control the real backlight elements according to the PWM duty ratios to generate the brightness corresponding to the backlight data, the amplitudes of the PWM signals can be a preset value, that is, preset current is output in reality.

In other embodiments of the disclosure, the backlight processing module can further send current data in advance to the PWM controllers, and the PWM controllers can adjust the real output current according to the current data and preset reference voltage to thereby control the real backlight elements to generate the brightness corresponding to the backlight data, here there is higher backlight brightness corresponding to larger output current given a duty ratio. The real output current Tout=(current data/Imax)×(Vref/Rs), here Vref represents the preset reference voltage, e.g., 500 mV, and Rs represents the resistance of a current sampling resistor below an MOS transistor, e.g., 1Ω. The current data are typically set by operating registers in the PWM controller, and if the bit width of the register is 10 bit, then Imax=1024 in the equation above, so the current data can be calculated as a function of Tout required in reality. For example, if current of 250 mA is required, then the current data will be set at 512 in the equation above. The PWM controllers typically include a number of cascaded chips, each of which can drive a number of PWM signals to be output to the strings of LED lamps.

It shall be noted that as illustrated in FIG. 9, a DC/DC converter is configured to convert voltage output by a power source into voltage required for a string of LED lamps, and to maintain the stable voltage as a function of a feedback from a feedback circuit, and moreover the backlight processing module can be detected for protection, here the backlight processing module can send an enable signal to the DC-DC converter after being started into operation so that the DC/DC converter starts to detect the backlight processing module for protection from over-voltage or over-current.

Figure 8:
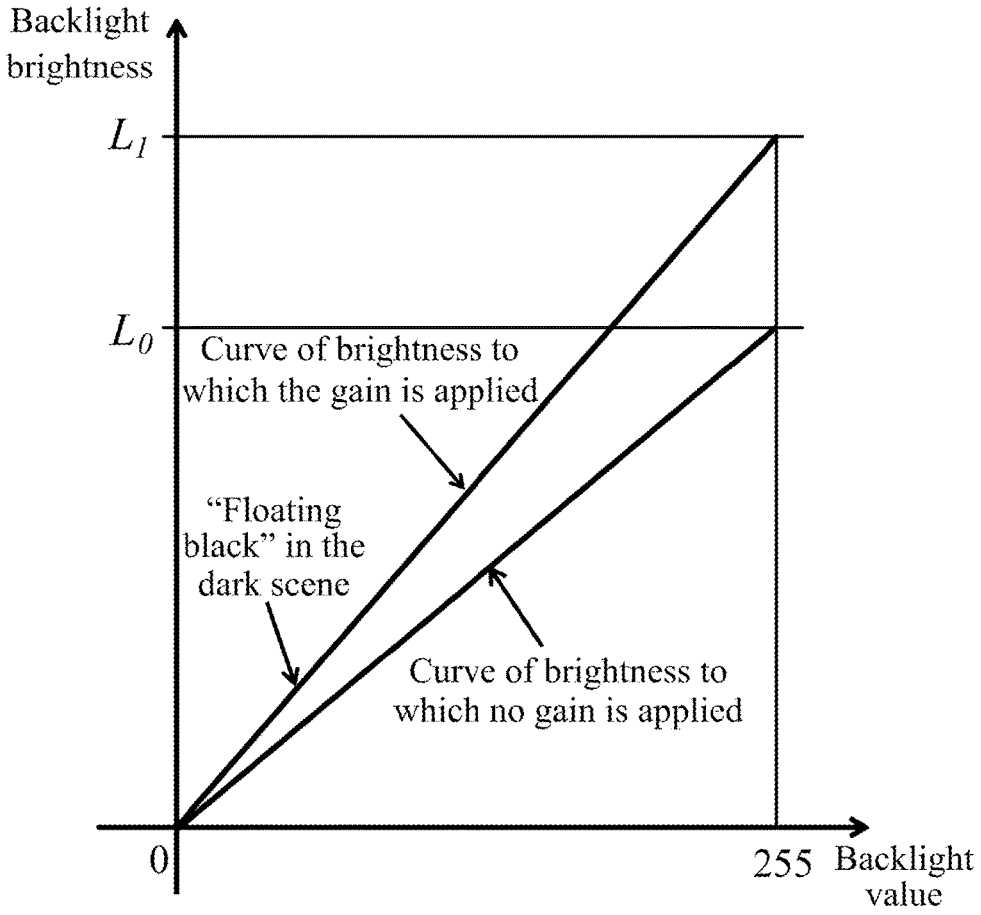
FIG. 8 is a schematic diagram of comparison between backlight values before and after a gain is applied according to the first embodiment of the disclosure.

In the some embodiments above of the disclosure, on one hand, the pre-obtained zone backlight values are calculated from the grayscale values of the zone image data blocks, and then the backlight gain coefficient is further obtained, and the respective pre-obtained zone backlight values are multiplied respectively with the backlight gain coefficient to obtain the zone backlight values to which the gain is applied, which are output to backlight driver circuits to drive backlight sources in the respective backlight zones, thus improving the backlight peak brightness, and further enhancing the dynamic contrast of the displayed image. As illustrated in FIG. 8 which is a schematic diagram of comparison between the backlight values before and after the gain is applied according to the first embodiment of the disclosure, the comparison between the unchanged and changed backlight brightness can show that the maximum peak brightness of backlight, in the brightness curve to which no gain is applied is L0, and the maximum peak brightness of backlight to which the gain is applied is L1, so there is a significant improvement of the backlight brightness in the brightness curve to which the gain is applied, over the brightness curve to which no gain is applied.

Figure 10A:
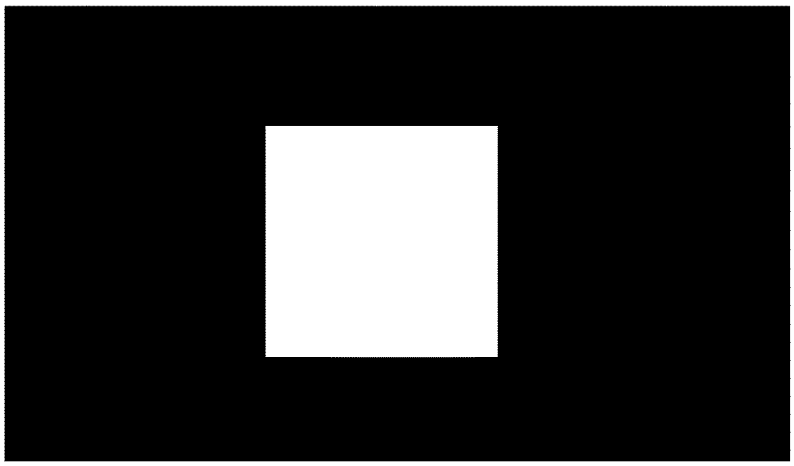
FIG. 10A is a schematic diagram of distributed brightness of pictures of an image showing a schematic diagram of a backlight value adjustment curve according to a second embodiment of the disclosure.
Figure 10B:
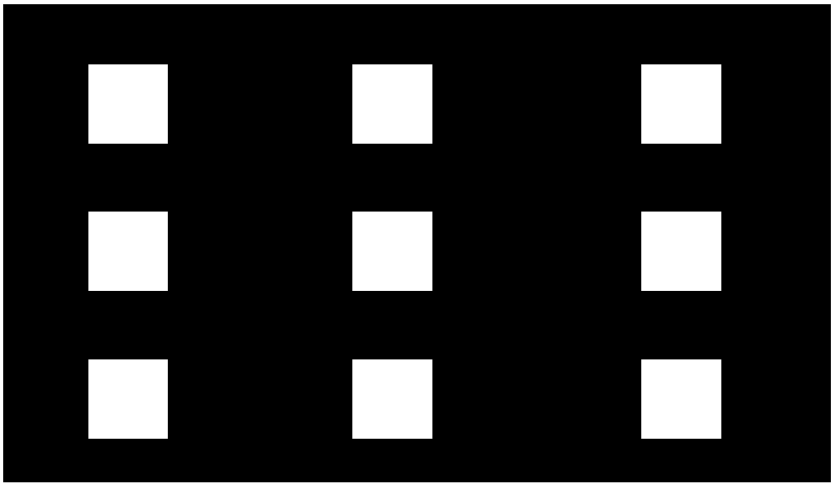
FIG. 10B is another schematic diagram of distributed brightness of pictures of an image showing a schematic diagram of another backlight value adjustment curve according to the second embodiment of the disclosure.

On the other hand, as can be apparent from the analysis above, although the backlight peak brightness after the gain is applied has been improved as compared with the backlight peak brightness before the gain is applied, as illustrated in FIG. 10A which is a schematic diagram of distributed brightness of the pictures of the image, and in FIG. 10B which is another schematic diagram of distributed brightness of the pictures of the image, there is a white window in some picture of the image in FIG. 10A, and the other pictures are black pictures; and there are nine white windows in some pictures of the image in FIG. 10B, and the other pictures are black pictures, here the area of the white window in FIG. 10A is the same as the total area of the nine white windows in FIG. 10B, so that the average brightness of the image is the same in FIG. 10A as in FIG. 10B, thus resulting in the same backlight gain coefficient; and if the backlight gain coefficient lies in the high brightness enhancement interval in FIG. 7A, then there is also the same corresponding zone backlight value in each white window, here the backlight brightness thereof is significantly improved so that the backlight brightness is high. However the backlight is diffused to the extent depending upon the backlight brightness, here if the backlight is brighter, then the backlight will be diffused in a larger range and at higher strength. As illustrated in FIG. 10B, the backlight is diffused strongly around each white window (i.e., the phenomenon of halo), here there would have been a black display area around each white window, but since the white windows are distributed, and the backlight is diffused around each white window, the entire black area of the image becomes whitish, thus lowering the contrast of the image; and in FIG. 10B, the white windows are centralized, here there is halo only around the white windows, and the halo radiates in a far smaller range than the radiation range of the nine windows in FIG. 10A, so that the entire black area of the image will be less influenced by the diffusion of the backlight, and the contrast of the image will be less lowered.

Figure 11:
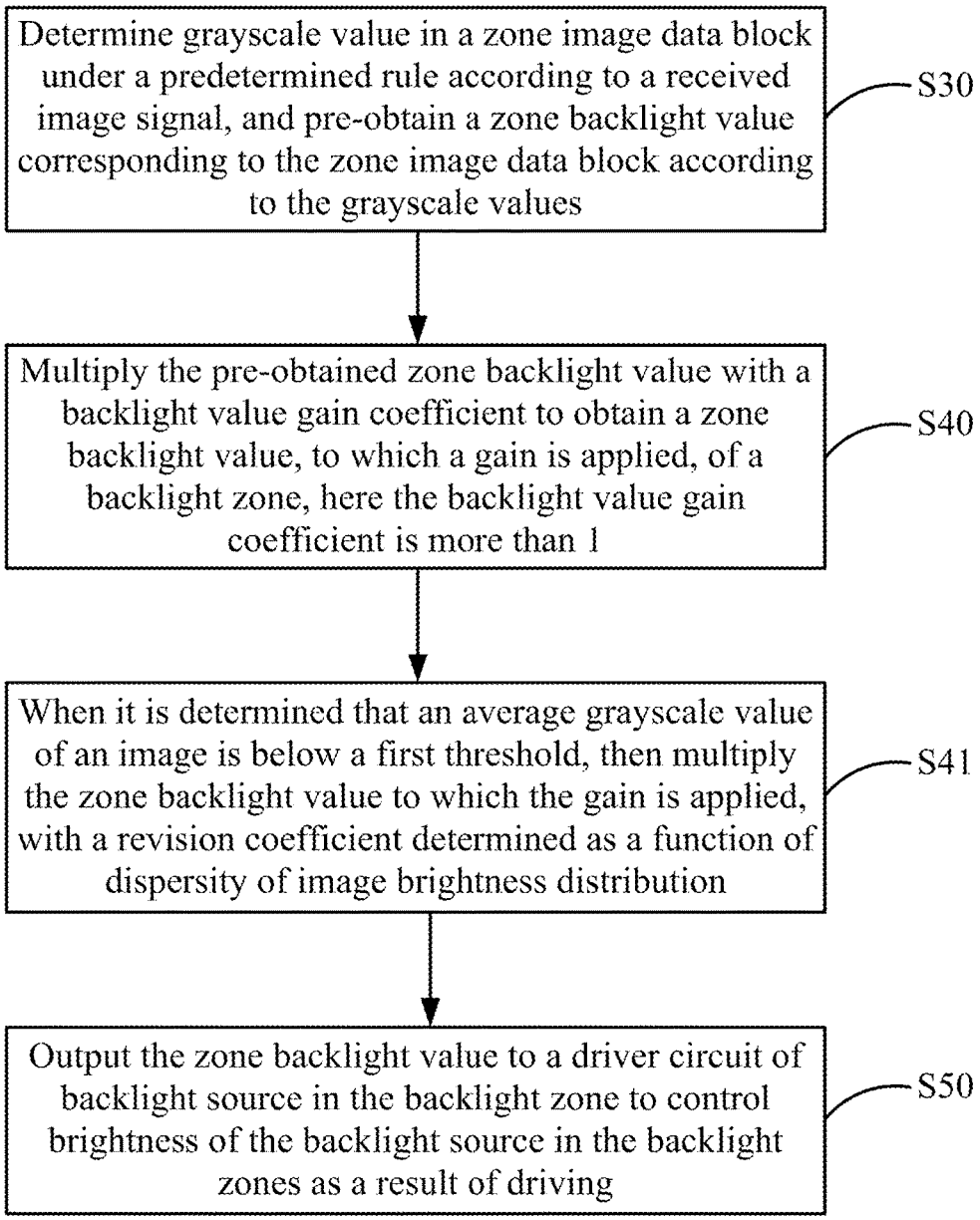
FIG. 11 is a schematic flow chart of a method for controlling liquid crystal display brightness according to the second embodiment of the disclosure.

In order to the problem above of the contrast of the image being lowered due to the discrete brightness distribution of the image, in the disclosure, given the enhanced backlight peak brightness, particularly if the average brightness of the image is below some threshold, then it will indicate that the pictures of the image include a dark scene, and if the brightness of the image is distributed at high dispersity, then the amplitude of the backlight gain will be lowered; and if the average brightness of the image is above some threshold, then it will indicate that the pictures of the image include no large-area dark scene, so the halo will have such an insignificant influence upon the image that the amplitude of the backlight gain thereof may not be lowered or may be insignificantly lowered In this embodiment, a revision coefficient is added, here it is determined from the average grayscale brightness of the image whether the image includes a large-area dark scene as a whole, and if so, then the zone backlight values to which the gain is applied will be revised, here the revision coefficient is determined as a function of dispersity of image brightness distribution. In another method for controlling liquid crystal display brightness according to this second embodiment, after the operation S40 in the first embodiment, as illustrated in FIG. 11 which is a schematic flow chart of a method for controlling liquid crystal display brightness according to the second embodiment.

The operation S41 is, when it is determined that an average grayscale value of the image is below a first threshold, to multiply a zone backlight value to which the gain is applied, with a revision coefficient determined as a function of dispersity of image brightness distribution, here the revision coefficient is less than 1.

It shall be noted that the dispersity of image brightness distribution characterizes the number of pictures of an image at high brightness among pictures of the image in the same area, here the number of pictures at high brightness increases with increasing dispersity. Here the size of the same area can be determined particularly dependent upon the design. The dispersity of image brightness distribution in FIG. 10B is nine times that in FIG. 10A. Moreover a brightness threshold against which a picture of the image at high brightness is judged can be determined particularly as required for the design, for example, if the grayscale value is above the grayscale of 200, then the picture will be determined as the area of a picture at high brightness.

Particularly if the first threshold of grayscale of the image is set so that the average grayscale value of the image is below the first threshold, then it will indicate that the image includes a large-area dark scene, and the phenomenon of halo may have a significant influence upon the image, so the backlight values to which the gain is applied will be revised by lowering them. If the average grayscale value of the image is above or at the first threshold, then it will indicate that the image includes a large-area bright scene, and the halo may have an insignificant influence upon the image, so the backlight values to which the gain is applied will not be revised. Here those skilled in the art can particularly select a parameter of the first threshold as required for the design without any inventive effort.

Figure 12:
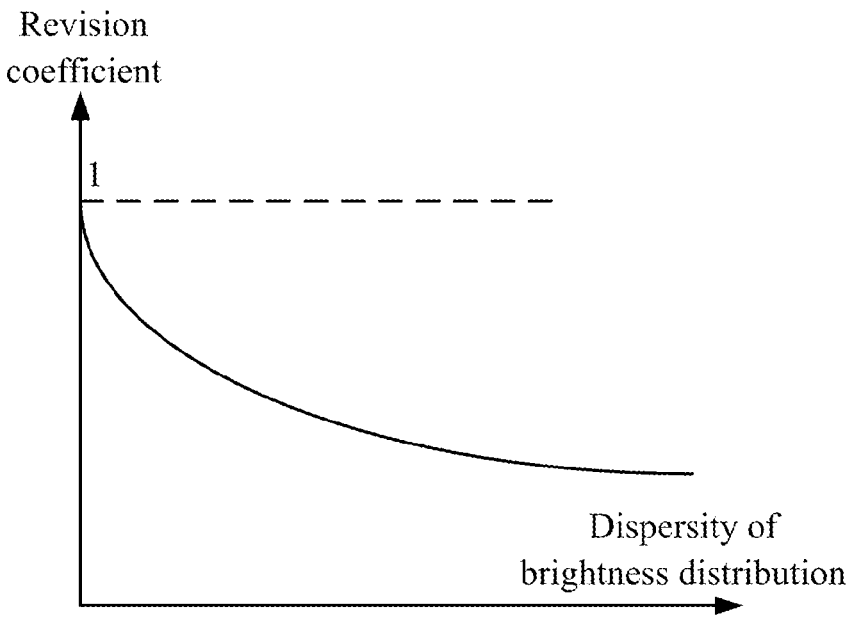
FIG. 12 is a schematic diagram of a fit revision curve of dispersity of image brightness distribution vs. a revision coefficient showing a schematic flow chart of another method for controlling liquid crystal display brightness according to the second embodiment of the disclosure.

Furthermore it shall be noted that the revision coefficient is determined according to a correspondence relationship between the dispersity of image brightness distribution and the revision coefficient. A lookup table can be preset in which the mapping relationship of the dispersity of image brightness distribution to the revision coefficient. As illustrated in FIG. 12 which is a schematic diagram of a fit revision curve of the dispersity of image brightness distribution vs. the revision coefficient, here if the dispersity of image brightness distribution is higher, then the revision coefficient thereof will be smaller, and if the dispersity of image brightness distribution is zero, that is, the pictures of the image include no areas of pictures of the image at high brightness, here the brightness of the pictures of the image is distributed uniformly, then the revision coefficient will be 1, and the backlight values to which the gain is applied will not be revised by lowering them; and if the dispersity of image brightness distribution becomes higher, which indicates that the brightness of the pictures of the image is not distributed uniformly, then the backlight values to which the gain is applied will be lowered, and the revision coefficient will become smaller, so that the contrast of the image can be adjusted by the zone backlight values corresponding to the respective areas at high and low brightness without applying unduly an excessive gain to the backlight peak brightness, thus alleviating the influence of the halo upon the areas of the black pictures.

By way of an example, if the backlight gain coefficient is obtained as in the first implementation of the embodiment, then the lookup table will be searched for the gain coefficient of global backlight using the average grayscale value of the global image. At this time, particularly in the operation S41, when it is determined that the average grayscale value of the global image is below the first threshold, then the zone backlight values to which the gain is applied will be multiplied with the revision coefficient determined as a function of the dispersity of brightness distribution in the global image, here the dispersity of brightness distribution in the global image is determined for pictures of a frame of image as a whole.

If the backlight gain coefficient is obtained as in the second implementation of the embodiment, then the average image grayscale value will be determined per zone image data block cluster, and the gain coefficient of the zone image data block cluster will be determined. At this time, particularly in the operation S41, when it is determined the average image grayscale value of the zone image data block cluster is below the first threshold, then a zone backlight value to which the gain is applied will be multiplied with the revision coefficient determined as a function of the dispersity of image brightness distribution in the zone image data block cluster, here the dispersity of image brightness distribution in the zone image data block cluster is determined for all zone image data blocks in the zone image data block clusters, which are regarded as pictures of the image as a whole.

Figure 13:
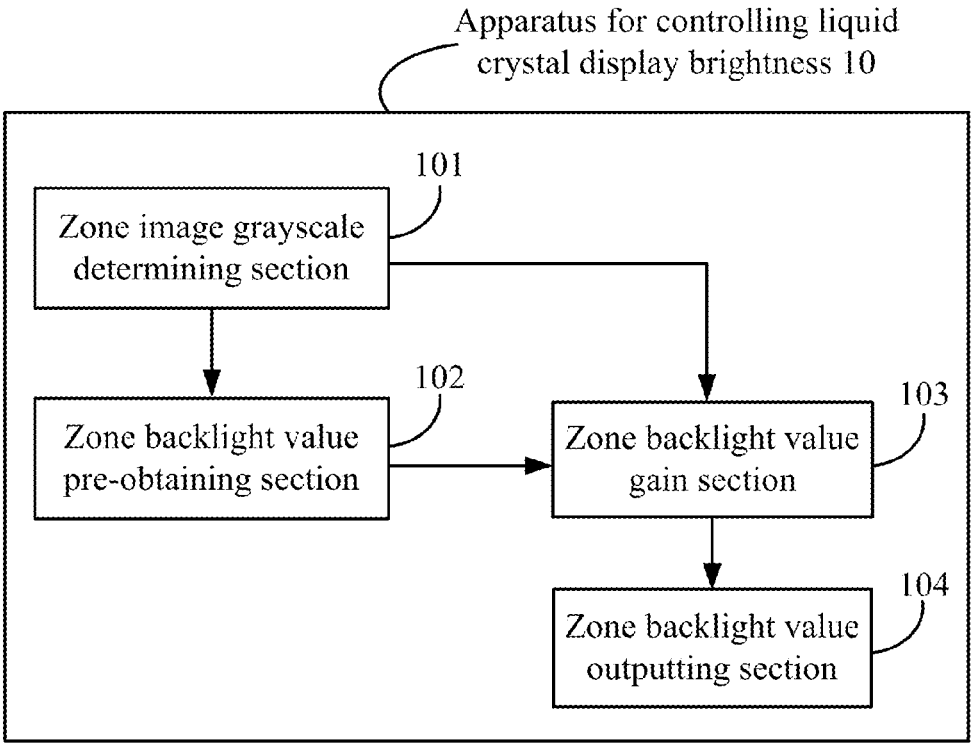
FIG. 13 is a schematic structural diagram of an apparatus for controlling liquid crystal display brightness according to a third embodiment of the disclosure.

As illustrated in FIG. 13 which is a schematic structural diagram of an apparatus for controlling liquid crystal display brightness according to a third embodiment of the disclosure, the apparatus 10 for controlling liquid crystal display brightness can be a single video processing chip or a number of video processing chips, e.g., two video processing chips, and the apparatus 10 for controlling liquid crystal display brightness can include:

A zone image grayscale determining section 101 is configured to determine grayscale value of pixels in a zone image data block under a predetermined rule according to a received image signal.

A zone backlight value pre-obtaining section 102 is configured to pre-obtain a zone backlight value corresponding to the zone image data block according to the grayscale values in the zone image data block.

A zone backlight value gain section 103 is configured to multiply the pre-obtained zone backlight value with a backlight value gain coefficient to obtain a backlight value, to which a gain is applied, of a backlight zone corresponding to the zone image data block, here the backlight value gain coefficient is more than 1.

A zone backlight value outputting section 104 is configured to output the zone backlight value to a driver circuit of backlight source in the backlight zone to control brightness of the backlight source in the backlight zone as a result of driving.

For details about the functions and processing flows of the respective modules in the apparatus for controlling liquid crystal display brightness according to this embodiment, reference can be made to the detailed description of the method for controlling liquid crystal display brightness according to the first embodiment above, so a repeated description thereof will be omitted here.

Figure 14A:
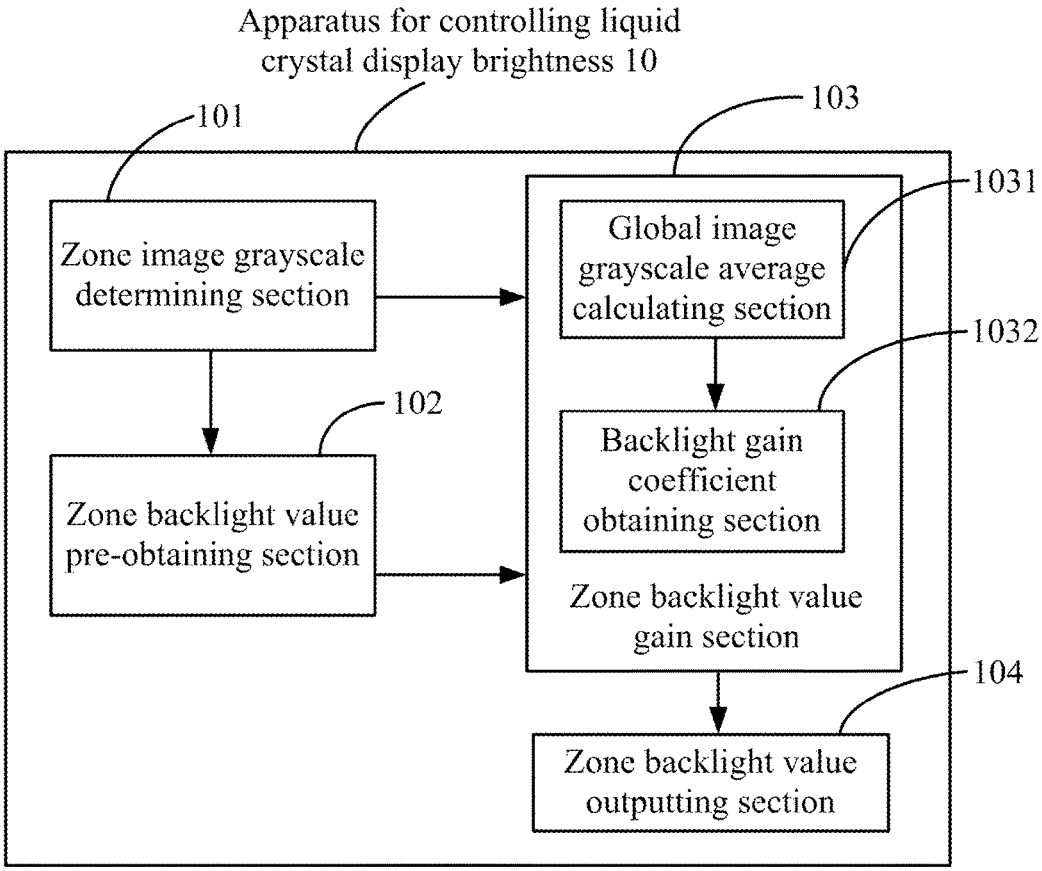
FIG. 14A is a schematic structural diagram of another apparatus for controlling liquid crystal display brightness according to the third embodiment of the disclosure.

As illustrated in FIG. 14A which is a schematic structural diagram of another apparatus for controlling liquid crystal display brightness according to this third embodiment of the disclosure, the zone backlight value gain section 103 particularly includes:

A global image grayscale average calculating section 1031 is configured to obtain an average grayscale value of a global image from grayscale values of the image; and A backlight gain coefficient obtaining module 1032 is configured to determine the backlight value gain coefficient according to a correspondence relationship between the average grayscale value of the global image and the backlight value gain coefficient.

Figure 14B:
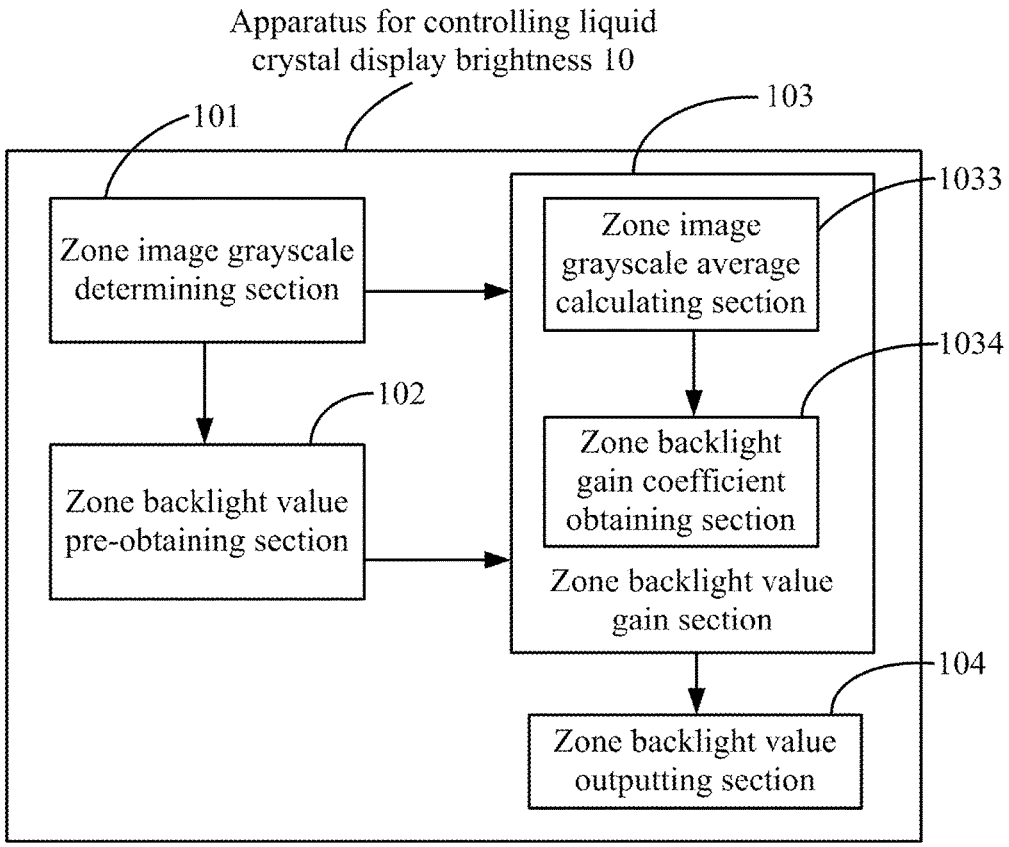
FIG. 14B is a schematic structural diagram of still another apparatus for controlling liquid crystal display brightness according to the third embodiment of the disclosure.

In another example, as illustrated in FIG. 14B which is a schematic structural diagram of still another apparatus for controlling liquid crystal display brightness according to this third embodiment, here the zone backlight value gain section 103 further includes:

A zone image grayscale average calculating section 1033 is configured to obtain an average grayscale value of all pixels in a zone image data block cluster, here all zone image data blocks are determined as a number of the zone image data block clusters, each of which includes a number of adjacent zone image data blocks; and A zone backlight gain coefficient obtaining module 1034 is configured to determine the backlight value gain coefficient according to a relationship between the zone image data block cluster and the backlight value gain coefficient.

The zone backlight value gain section 103 is particularly configured:

To preset a number of gain coefficient lookup tables, here there are at least two zone image data block clusters corresponding to different lookup tables in which different relationships between the backlight value gain coefficient and the average grayscale value are recorded.

The zone backlight value gain section 103 is particularly configured:

To match a gain coefficient relationship lookup table to a position here a zone image data block cluster is distributed on a display area.

The zone backlight value gain section 103 particularly includes:

A gain curve between the average grayscale value of the image and the backlight value gain coefficient is recorded in each of the backlight value gain coefficient lookup tables, here the gain curve is divided into a low brightness enhancement interval, a high brightness enhancement interval, and a power control interval while the average grayscale value of the image is increasing, and gain coefficients in the high brightness enhancement interval are more than those in the low brightness enhancement interval and the power control interval respectively.

For details about the functions and processing flows of the respective modules in the apparatus for controlling liquid crystal display brightness according to this embodiment, reference can be made to the detailed description of the method for controlling liquid crystal display brightness according to the first embodiment above, so a repeated description thereof will be omitted here.

Figure 15:
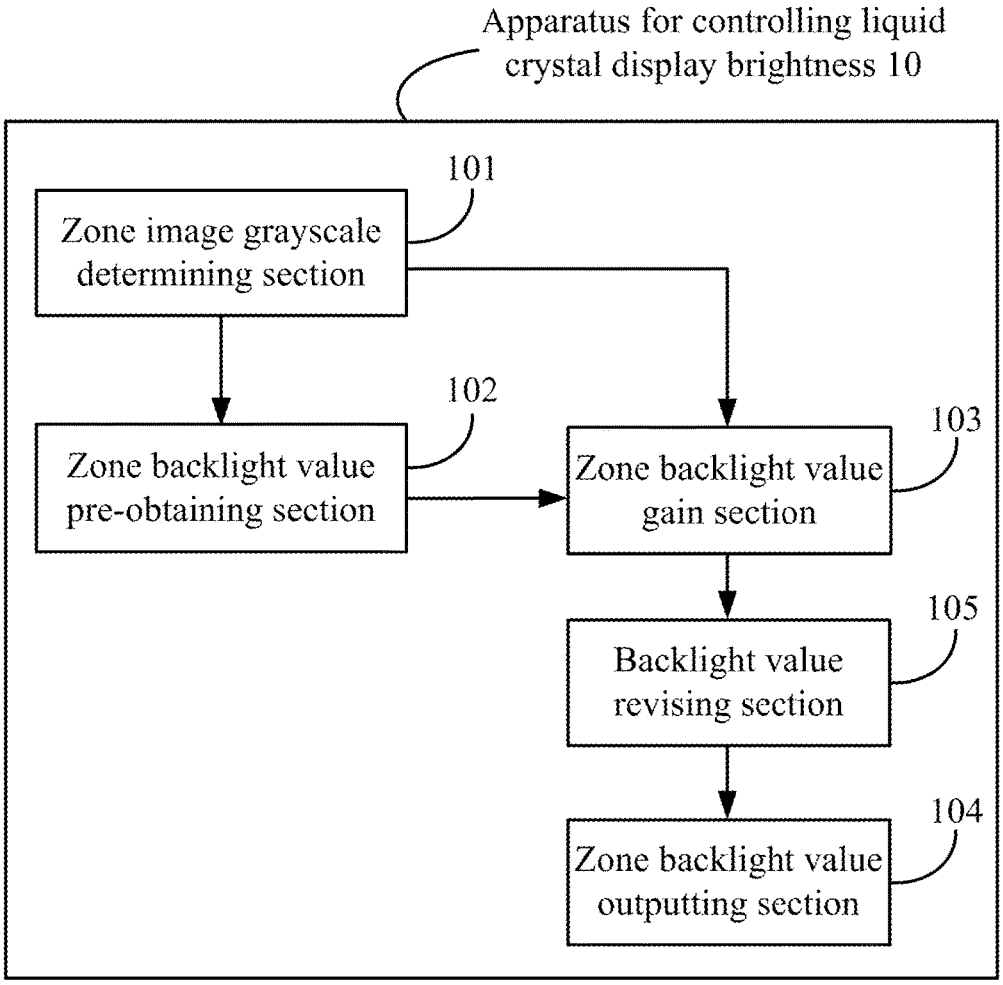
FIG. 15 is a schematic structural diagram of an apparatus for controlling liquid crystal display brightness according to a fourth embodiment of the disclosure.

As illustrated in FIG. 15 which is a schematic structural diagram of an apparatus for controlling liquid crystal display brightness according to a fourth embodiment of the disclosure, the apparatus 10 for controlling liquid crystal display brightness can be a single video processing chip or a number of video processing chips, e.g., two video processing chips, and unlike the third embodiment, the apparatus 10 for controlling liquid crystal display brightness further includes between the zone backlight value gain section 103 and the zone backlight value outputting section 104:

A backlight value revising section 105 is configured, when it is determined that an average grayscale value of an image is below a first threshold, to multiply a zone backlight value to which the gain is applied, with a revision coefficient determined as a function of dispersity of image brightness distribution, here the revision coefficient is less than 1.

For details about the functions and processing flows of the respective modules in the apparatus for controlling liquid crystal display brightness according to this embodiment, reference can be made to the detailed description of the method for controlling liquid crystal display brightness according to the second embodiment above, so a repeated description thereof will be omitted here.

Figure 16:
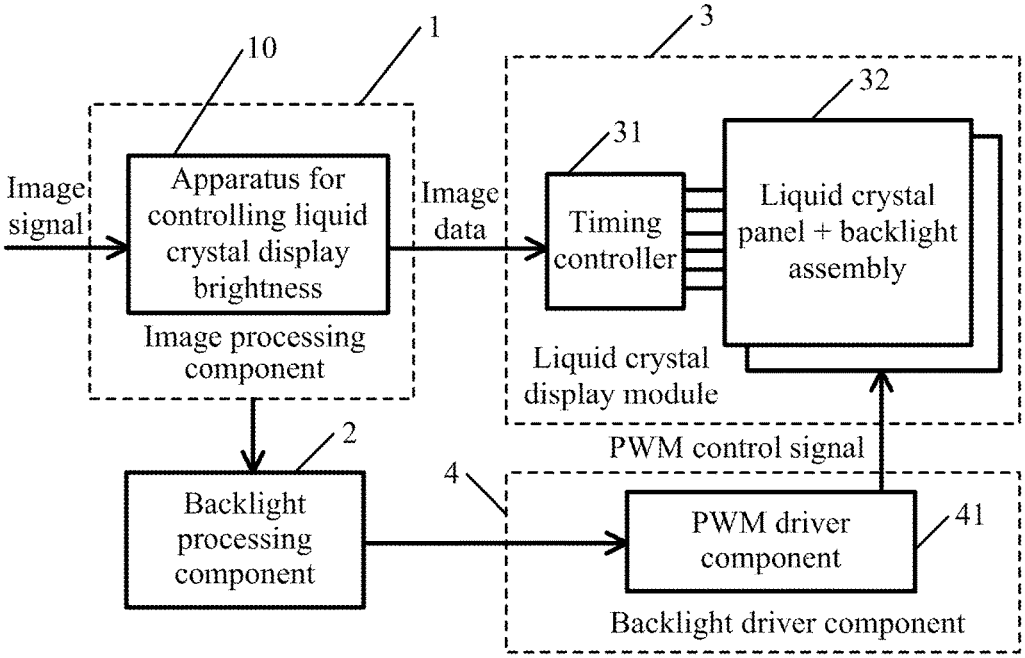
FIG. 16 is a schematic structural diagram of a liquid crystal display device according to a fifth embodiment of the disclosure.

As illustrated in FIG. 16 which is a schematic structural diagram of a liquid crystal display device according to a fifth embodiment of the disclosure, the liquid crystal display device includes an image processing component 1, a memory (not illustrated), a liquid crystal display module 3, a backlight processing component 2, and a backlight driver component 4, here:

The memory is configured to store programs and various preset lookup table data;

The image processing component 1 includes the apparatus 10 for controlling liquid crystal display brightness configured to execute the programs in the memory, and to invoke the various lookup table data according to the executed programs;

The apparatus 10 for controlling liquid crystal display brightness is further configured to receive an image signal, to process the data, and to output the image data to a timing controller (Tcon) in the liquid crystal display component 3 so that the Tcon generates a driver signal according to the image data to control a liquid crystal panel to display the image;

The apparatus 10 for controlling liquid crystal display brightness is further configured to output zone backlight values to the backlight processing component 2 according to the image signal;

The backlight processing component 2 is configured to determine duty ratios of corresponding PWM signals according to the respective zone backlight values, and to output the duty ratios to a PWM driver component 41 in the backlight driver component 4; and The PWM driver component 41 is configured to generate PWM control signals to control backlight sources of zones in the backlight component 32.

Here the apparatus 10 for controlling liquid crystal display brightness is any one of the apparatuses 10 for controlling liquid crystal display brightness according to the third embodiment and the fourth embodiment, so a repeated description of the particular functions of the apparatus 10 for controlling liquid crystal display brightness is will be omitted here.

Figure 17:
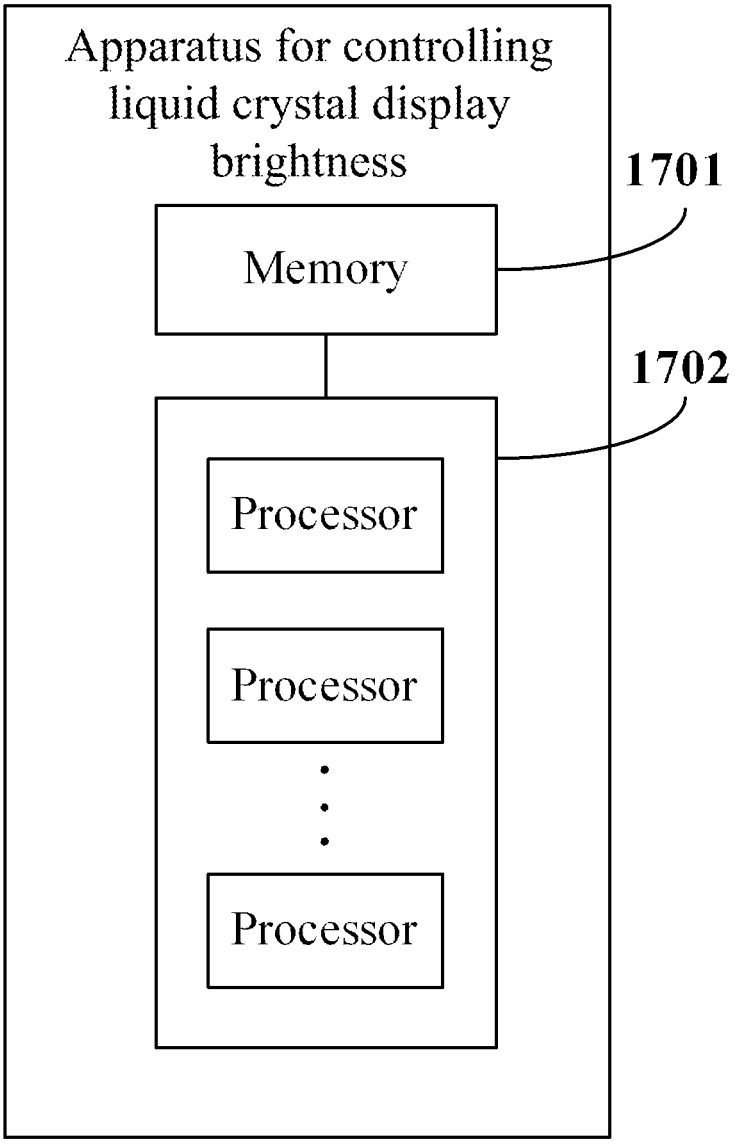
FIG. 17 is a schematic structural diagram of an apparatus for controlling liquid crystal display brightness according to an embodiment of the disclosure.

As illustrated in FIG. 17, an embodiment of the disclosure provides an apparatus for controlling liquid crystal display brightness, which includes a memory 1701 and one or more processors 1702, here one or more computer readable program codes are stored in the memory 1701, and the one or more processors 1702 are configured to execute the one or more computer readable program codes to perform:

Determining grayscale values in a zone image data block under a predetermined rule according to a received image signal;

Pre-obtaining a zone backlight value corresponding to the zone image data block according to the grayscale values in the zone image data block;

Multiplying the pre-obtained zone backlight value with a backlight value gain coefficient to obtain a backlight value, to which a gain is applied, of the backlight zone, here the backlight value gain coefficient is more than 1; and Outputting the zone backlight value to a driver circuit of backlight source in the backlight zone to control brightness of the backlight source in the backlight zone as a result of driving.

Optionally the one or more processors 1702 are further configured to execute the one or more computer readable program codes to perform:

when it is determined that the average grayscale value of the image is below a first threshold, then multiplying the zone backlight value to which the gain is applied, with a revision coefficient determined as a function of dispersity of image brightness distribution, here the revision coefficient is less than 1.

Optionally the backlight value gain coefficient is obtained by:

Obtaining an average grayscale value of a global image from grayscale values of the image; and Determining the backlight value gain coefficient according to a correspondence relationship between the average grayscale value of the global image and the backlight value gain coefficient.

Optionally when it is determined that the average grayscale value of an image is below the first threshold, then multiplying the zone backlight value to which the gain is applied, with the revision coefficient determined as a function of the dispersity of image brightness distribution includes:

when it is determined that the average grayscale value of a global image is below the first threshold, then multiplying the zone backlight value to which the gain is applied, with the revision coefficient determined as a function of dispersity of brightness distribution of the global image.

Optionally the backlight value gain coefficient is obtained by:

Obtaining an average grayscale value of all pixels in a zone image data block cluster, here all zone image data blocks are determined as a number of the zone image data block clusters, each of which includes a number of adjacent zone image data blocks; and Determining the backlight value gain coefficient according to a relationship between the zone image data block cluster and the backlight value gain coefficient.

Optionally when it is determined that the average grayscale value of the image is below the first threshold, then multiplying the zone backlight value to which the gain is applied, with the revision coefficient determined as a function of the dispersity of image brightness distribution includes:

when it is determined that the average grayscale value of the zone image data block cluster is below the first threshold, then multiplying the zone backlight value to which the gain is applied, with the revision coefficient determined as a function of dispersity of image brightness distribution in the zone image data block cluster.

Those ordinarily skilled in the art can appreciate that all or a part of the operations in the methods according to the embodiments described above can be performed by program instructing relevant hardware, here the programs can be stored in a computer readable storage medium, and the programs can perform one or a combination of the operations in the method embodiments upon being executed; and the storage medium includes an ROM, an RAM, a magnetic disc, an optical disk, or any other medium which can store program codes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A method for controlling brightness of a liquid crystal display, the method comprising:

determining grayscale values of pixels in a zone image data block under a predetermined rule according to a received image signal, wherein the predetermined rule includes a pre-stored function model in which the liquid crystal display is divided into a number of virtual zones at the same proportion as backlight zones and image data of all pixels displayed in one of the virtual zones are aggregated into the zone image data block;

pre-obtaining a zone backlight value corresponding to the zone image data block according to the determined grayscale values of the pixels in the zone image data block;

multiplying the pre-obtained zone backlight value with a backlight value gain coefficient to obtain a gained backlight value of a backlight zone corresponding to the zone image data block, wherein the backlight value gain coefficient is greater than 1 to enhance a zone peak brightness corresponding to the zone image data block;

when it is determined that an average grayscale value of pixels in a zone image data block cluster is below a first threshold, multiplying the gained backlight value with a revision coefficient determined according to a dispersity of image brightness distribution of the zone image data block cluster, wherein multiple zone image data blocks including said zone image data block are divided into multiple zone image data block clusters including said data block cluster, each of the zone image data block clusters comprises a number of adjacent ones of the zone image data blocks, and the revision coefficient is less than 1; and outputting the gained backlight value to a driver circuit of a backlight source in the backlight zone to control brightness of the backlight source in the backlight zone.

2. The method of claim 1, wherein after multiplying the pre-obtained zone backlight value with the backlight value gain coefficient to obtain the gained backlight value of the backlight zone, the method further comprises:

when it is determined that an average grayscale value of the pixels in the zone image data block is below the first threshold, multiplying the gained backlight value with a revision coefficient determined according to a dispersity of image brightness distribution of the zone image data block, wherein the revision coefficient is less than 1.

3. The method of claim 2, wherein the revision coefficient determined according to the dispersity of image brightness distribution of the zone image data block and the dispersity of image brightness distribution of the zone image data block have an inverse correspondence relationship where a smaller revision coefficient corresponds to a larger dispersity of image brightness distribution.

4. The method of claim 1, wherein after multiplying the pre-obtained zone backlight value with the backlight value gain coefficient to obtain the gained backlight value of the backlight zone, the method further comprises:

when it is determined that an average grayscale value of pixels in an image comprising the zone image data block is below the first threshold, multiplying the gained backlight value with a revision coefficient determined according to a dispersity of image brightness distribution of the image;

wherein the revision coefficient determined according to the dispersity of image brightness distribution of the image is less than 1, and the revision coefficient determined according to the dispersity of image brightness distribution of the image and the dispersity of image brightness distribution of the image have an inverse correspondence relationship where a smaller revision coefficient corresponds to a larger dispersity of image brightness distribution.

5. The method of claim 4, wherein the backlight value gain coefficient is obtained by:

obtaining an average grayscale value of pixels in the image from grayscale values of pixels in the image; and determining the backlight value gain coefficient according to a correspondence relationship between the average grayscale value of the pixels in the image and the backlight value gain coefficient.

6. The method of claim 1, wherein the revision coefficient and the dispersity of image brightness distribution have an inverse correspondence relationship where a smaller revision coefficient corresponds to a larger dispersity of image brightness distribution.

7. The method of claim 6, wherein the backlight value gain coefficient is obtained by:

obtaining the average grayscale value of all pixels in the zone image data block cluster, and determining the backlight value gain coefficient according to a relationship between the average grayscale value and the backlight value gain coefficient.

8. A liquid crystal display device, comprising:

a memory configured to store programs and various preset lookup table data;

an apparatus for controlling brightness of a liquid crystal display; the apparatus configured to:

execute the programs stored in the memory, and invoke the various lookup table data according to the executed programs;

receive an image signal, process image data, and output the image data to a timing controller so that the timing controller generates a driver signal according to the image data to control a liquid crystal panel to display an image; and output zone backlight values to a backlight processing component according to the image signal;

the backlight processing component configured to determine duty ratios of corresponding PWM signals according to the zone backlight values, and to output the duty ratios to a PWM driver component; and the PWM driver component configured to generate PWM control signals to control backlight sources in backlight zones;

wherein the apparatus for controlling brightness of the liquid crystal display includes a memory and one or more processors, wherein one or more computer readable program codes are stored in the memory, and the one or more processors are configured to execute the one or more computer readable program codes to perform:

determining grayscale values in a zone image data block under a predetermined rule according to a received image signal, wherein the predetermined rule includes a pre-stored function model in which the liquid crystal panel is divided into a number of virtual zones at the same proportion as the backlight zones and the image data of all pixels displayed in one of the virtual zones are aggregated into the zone image data block;

pre-obtaining a zone backlight value corresponding to the zone image data block according to the determined grayscale values of the pixels in the zone image data block;

multiplying the pre-obtained zone backlight value with a backlight value gain coefficient to obtain a gained backlight value of a backlight zone corresponding to the zone image data block, wherein the backlight value gain coefficient is greater than 1 to enhance a zone peak brightness corresponding to the zone image data block;

when it is determined that an average grayscale value of pixels in an image comprising the zone image data block is below a first threshold, multiplying the gained backlight value with a revision coefficient determined according to a dispersity of image brightness distribution of the image, wherein the revision coefficient is less than 1;

outputting the gained backlight value to a driver circuit of a backlight source in the backlight zone to control brightness of the backlight source in the backlight zone.

9. The liquid crystal display device of claim 8, wherein the one or more processors are further configured to execute the one or more computer readable program codes to perform:

when it is determined that an average grayscale value of the pixels in the zone image data block is below the first threshold, multiplying the gained backlight value with a revision coefficient determined according to a dispersity of image brightness distribution of the zone image data block, wherein the revision coefficient is less than 1.

10. The liquid crystal display device of claim 8, wherein the one or more processors are further configured to execute the one or more computer readable program codes to perform:

when it is determined that an average grayscale value of pixels in a zone image data block cluster is below the first threshold, multiplying the gained backlight value with a revision coefficient determined according to a dispersity of image brightness distribution of the zone image data block cluster, wherein multiple zone image data blocks including said zone image data block are divided into multiple zone image data block clusters including said zone image data block cluster, and each of the zone image data block clusters comprises a number of adjacent ones of the zone image data blocks, wherein the revision coefficient determined according to the dispersity of image brightness distribution of the zone image data block cluster is less than 1.

11. The liquid crystal display device of claim 8, wherein the one or more processors are configured to execute the one or more computer readable program codes to perform:

obtaining the backlight value gain coefficient by:

obtaining the average grayscale value of pixels in the image from grayscale values of the image; and determining the backlight value gain coefficient according to a correspondence relationship between the average grayscale value and the backlight value gain coefficient.

12. The liquid crystal display device of claim 10, wherein the one or more processors are configured to execute the one or more computer readable program codes to perform:

obtaining the backlight value gain coefficient by:

obtaining the average grayscale value of pixels in the zone image data block cluster, and determining the backlight value gain coefficient according to a relationship between the average grayscale value and the backlight value gain coefficient.

13. A method for controlling brightness of a liquid crystal display, the method comprising:

determining grayscale values of pixels in a zone image data block under a predetermined rule according to a received image signal, wherein the predetermined rule includes a pre-stored function model in which the liquid crystal display is divided into a number of virtual zones at the same proportion as backlight zones and image data of all pixels displayed in one of the virtual zones are aggregated into the zone image data block;

pre-obtaining a zone backlight value corresponding to the zone image data block according to the determined grayscale values in the pixels of the zone image data block;

multiplying the pre-obtained zone backlight value with a backlight value gain coefficient to obtain a gained backlight value of a backlight zone corresponding to the zone image data block, wherein the backlight value gain coefficient is greater than 1;

when it is determined that an average grayscale value of pixels in the zone image data block is below a first threshold, multiplying the gained backlight value to with a revision coefficient determined according to a dispersity of image brightness distribution of the zone image data block, wherein the revision coefficient is less than 1; and outputting the zone backlight value to a driver circuit of a backlight source in the backlight zone to control brightness of the backlight source.

14. The method of claim 13, wherein the revision coefficient and the dispersity of image brightness distribution have an inverse correspondence relationship where a smaller revision coefficient corresponds to a larger dispersity of image brightness distribution.

15. The method of claim 13, wherein after multiplying the pre-obtained zone backlight value with the backlight value gain coefficient to obtain the gained backlight value of the backlight zone, the method further comprises:

when it is determined that an average grayscale value of pixels in an image comprising at least one zone image data block is below a first threshold, multiplying the gained backlight value with a revision coefficient determined according to a dispersity of image brightness distribution of the image;

wherein the revision coefficient is less than 1, and the revision coefficient and the dispersity of image brightness distribution have an inverse correspondence relationship where a smaller revision coefficient corresponds to a larger dispersity of image brightness distribution.

16. The method of claim 15, wherein the backlight value gain coefficient is obtained by:

obtaining an average grayscale value of pixels in the image from grayscale values of pixels in the image; and determining the backlight value gain coefficient according to a correspondence relationship between the average grayscale value and the backlight value gain coefficient.

17. The method of claim 13, wherein after multiplying the pre-obtained zone backlight value with the backlight value gain coefficient to obtain the gained backlight value of the backlight zone, the method further comprises:

when it is determined that an average grayscale value of pixels in a zone image data block cluster is below a first threshold, multiplying the gained backlight value with a revision coefficient determined according to a dispersity of image brightness distribution of the zone image data block cluster, wherein all zone image data blocks are divided into multiple zone image data block clusters, and each of the zone image data block clusters comprises multiple adjacent ones of the zone image data blocks;

wherein the revision coefficient is less than 1, and the revision coefficient and the dispersity of image brightness distribution have an inverse correspondence relationship where a smaller revision coefficient corresponds to a larger dispersity of image brightness distribution.

18. The method of claim 17, wherein the backlight value gain coefficient is obtained by:

obtaining an average grayscale value of all pixels in the zone image data block cluster, and determining the backlight value gain coefficient according to a relationship between the average grayscale value and the backlight value gain coefficient.

* * * * *